US011884451B2

(12) United States Patent
Zitron et al.

(10) Patent No.: US 11,884,451 B2
(45) Date of Patent: Jan. 30, 2024

(54) MODULAR UTILITY BOTTLE

(71) Applicant: MODL, Inc., Dunwoody, GA (US)

(72) Inventors: Victor Barak Zitron, Sandy Springs, GA (US); Zachary W. Leitz, Dunwoody, GA (US); Justin Guld, Raleigh, NC (US)

(73) Assignee: MODL, Inc., Dunwoody, GA (US)

( * ) Notice: Subject to any disclaimer, the term of this patent is extended or adjusted under 35 U.S.C. 154(b) by 0 days.

(21) Appl. No.: 17/671,538

(22) Filed: Feb. 14, 2022

(65) Prior Publication Data

US 2022/0169419 A1 Jun. 2, 2022

Related U.S. Application Data

(63) Continuation of application No. 16/536,261, filed on Aug. 8, 2019, now Pat. No. 11,261,005.

(60) Provisional application No. 62/811,533, filed on Feb. 27, 2019, provisional application No. 62/716,227, filed on Aug. 8, 2018.

(51) Int. Cl.

| | |
|---|---|
| ***B65D 21/08*** | (2006.01) |
| ***B65D 25/04*** | (2006.01) |
| ***B65D 41/04*** | (2006.01) |
| ***B65D 85/72*** | (2006.01) |
| ***B65D 25/42*** | (2006.01) |

(52) U.S. Cl.

CPC ..... *B65D 21/083* (2013.01); *B65D 25/04* (2013.01); *B65D 25/42* (2013.01); *B65D 41/0442* (2013.01); *B65D 85/72* (2013.01); *B65D 2251/0003* (2013.01)

(58) Field of Classification Search

CPC .. B65D 21/083; B65D 23/102; B65D 23/108; B65D 25/32; B65D 25/42; B65D 51/242; B65D 51/1644; B65D 25/2876; B65D 2525/283; B65D 2525/285; A45F 3/18; A45F 2005/1013

See application file for complete search history.

(56) References Cited

U.S. PATENT DOCUMENTS 2,843,281 A * 7/1958 Gallois ..... A61J 11/045 215/11.1
3,093,257 A * 6/1963 Miller ..... B65D 23/108 29/451

(Continued)

FOREIGN PATENT DOCUMENTS

CN 202262760 U 6/2012
CN 103932490 A 7/2014

(Continued)

*Primary Examiner* — J C Jacyna

(74) *Attorney, Agent, or Firm* — Skaar Ulbrich Macari, P.A.

(57) ABSTRACT

A modular bottle (e.g., for holding liquid or dry storage contents) and its various assemblies, components, and structures are provided. The bottle can include a body portion including an open longitudinal end and an interior region, an end cap configured to be secured over the open longitudinal end to enclose the interior region, and a flexible loop. The end cap can include a pair of knobs disposed on a circumferential side surface of the end cap. Each end of the flexible loop can define an aperture that is smaller than a largest diameter of each of the pair of knobs such that each end of the flexible loop is selectively couplable with each of the pair of knobs.

16 Claims, 24 Drawing Sheets

(56) References Cited

U.S. PATENT DOCUMENTS

| | | | | | |
|---|---|---|---|---|---|
| 3,119,541 | A * | 1/1964 | Lynn | B65D 51/242 | 229/5.5 |
| 3,339,794 | A * | 9/1967 | Radtke | B65D 25/32 | 220/592.16 |
| 3,412,887 | A * | 11/1968 | Swartwood | B65D 23/108 | 215/397 |
| 4,444,324 | A | 4/1984 | Grenell | | |
| 2006/0186076 | A1* | 8/2006 | Shiloni | B65D 51/1644 | 215/229 |
| 2008/0277418 | A1* | 11/2008 | Vockler | B65D 43/0212 | 222/111 |
| 2016/0150914 | A1 | 6/2016 | Waggoner et al. | | |
| 2016/0166094 | A1* | 6/2016 | Tebbe | B65D 23/104 | 220/709 |
| 2017/0112309 | A1 | 4/2017 | Van Asseldonk et al. | | |
| 2019/0084734 | A1* | 3/2019 | Ni | B65D 47/0876 | |

FOREIGN PATENT DOCUMENTS

| | | | |
|---|---|---|---|
| CN | 206687549 | U | 12/2017 |
| CN | 107595055 | A | 1/2018 |
| CN | 206836726 | U | 1/2018 |
| GB | 2331501 | A | 5/1999 |
| JP | 242594 | * | 11/1990 |
| JP | 2000128218 | A | 5/2000 |
| TW | 346102 | U | 11/1998 |
| WO | 2012059915 | A1 | 5/2012 |
| WO | 2017152192 | A1 | 9/2017 |

* cited by examiner

MODULAR UTILITY BOTTLE

PRIORITY

This application is a continuation of U.S. patent application Ser. No. 16/536,261, filed Aug. 8, 2019, which claims priority to and the benefit of U.S. Provisional Patent Application No. 62/716,227, filed Aug. 8, 2018, and U.S. Provisional Patent Application No. 62/811,533, filed Feb. 27, 2019, with each of the referenced applications and disclosures incorporated fully herein by reference.

FIELD

The present invention relates generally to containers and, more particularly, to a modular container or bottle configured to provide dynamic functionality with substitute or alternative structural modifications.

BACKGROUND

Conventional water bottles are intended to carry water and not much else. While there are specialty bottles that do provide alternative functionality, they are generally limited to a static, non-modular set of additional functions. In addition, conventional water bottles take up significant space when not in use, are not collapsible, undesirably have only one fixed anchor or attachment point which makes the bottle difficult to secure, difficult to clean (e.g., dirt, mold, bacteria, etc.) in hard to reach interior spaces and crevices, and they inconveniently roll when placed on their side due to their traditional cylindrical shape.

Thus, in the status quo, outdoor adventurers and enthusiasts are missing a tool that brings utility knife-style multifunctionality to hydration-related and other functions and needs.

Accordingly, there is a need for new and improved devices and methods to solve the innately one-dimensional functionality of conventional bottles or container devices.

SUMMARY

Embodiments of the present invention comprise a modular bottle (e.g., for holding liquid or dry storage contents) and its various accessories, components, and structures. The bottle is dynamically modular and is configured to be particularly useful for outdoorspeople, military personnel, travelers, pet owners, and the like. The bottle is a double-ended device capable of being modified or expanded with various caps, filters, infusers, purifiers, etc.

The bottle can include a body portion and one or more end caps or other accessories. The body portion can include one or more openings and is adapted to facilitate component attachment, and one or more side flat regions provided to minimize or prevent rolling of the bottle, as well as provide the user with a better grip on the bottle. The body portion can be constructed of a generally flexible material, such as silicone rubber or other like materials, that can be collapsed or flattened to facilitate storage, transportation, cleaning, etc. In other embodiments, the body portion can be constructed of a rigid or semi-rigid material, such as metals (e.g., stainless steel), polymers, and the like. Further, the body portion can include a double-walled or like insulated construction. The end caps can be threadably coupled directly to the ends/necks of the body portion or coupled via an end assembly.

With various embodiments, the bottle can comprise an end assembly including a gasket, a nut, a washer, and a mouthpiece. With other embodiments, the bottle can comprise an end assembly including a stainless-steel ring provided with the silicone mouthpiece or ends of the bottle. Various caps or accessories can be used with the bottle to facilitate various design benefits. These caps or accessories provide a truly modular bottle adapted to promote a myriad of additional functions and features, with embodiments of the caps and accessories adapted for securement or attachment to the bottle via the end assembly.

The above summary is not intended to describe each illustrated embodiment, claimed embodiment or implementation of the invention. The detailed technology and preferred embodiments implemented for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

BRIEF DESCRIPTION OF THE DRAWINGS

The invention may be more completely understood in consideration of the following detailed description of various embodiments of the invention in connection with the accompanying drawings, in which.

Figure 1:
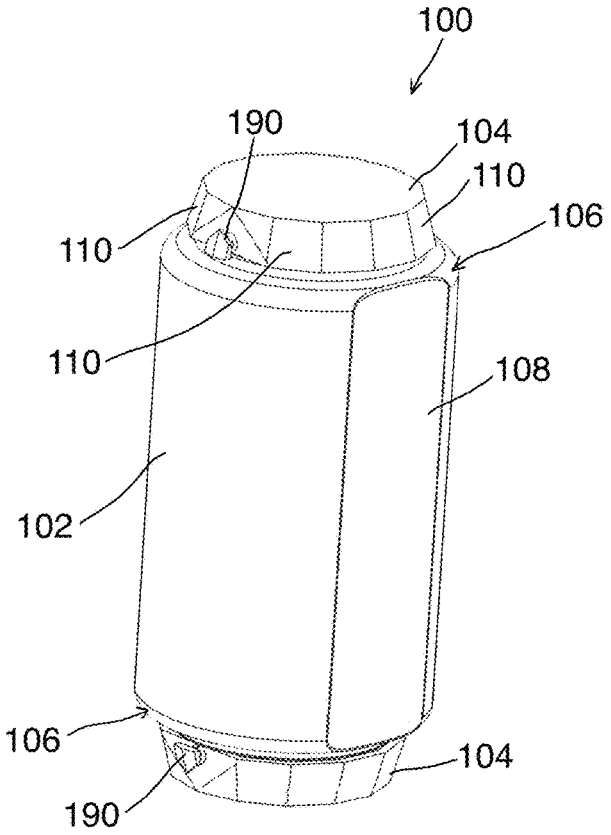
FIGS. 1-2 show a modular utility bottle having dual end caps, in accordance with embodiments of the present invention.
Figure 2:
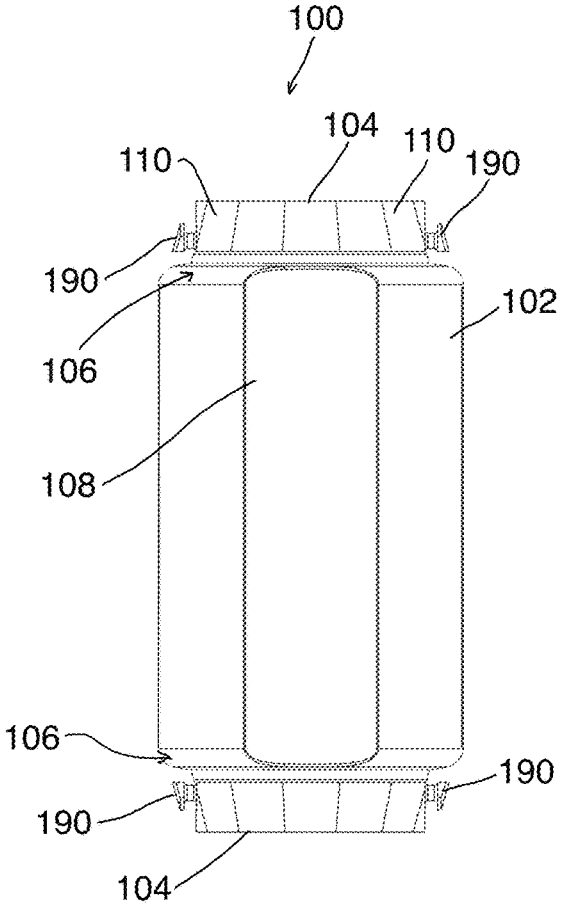
Figure 3:
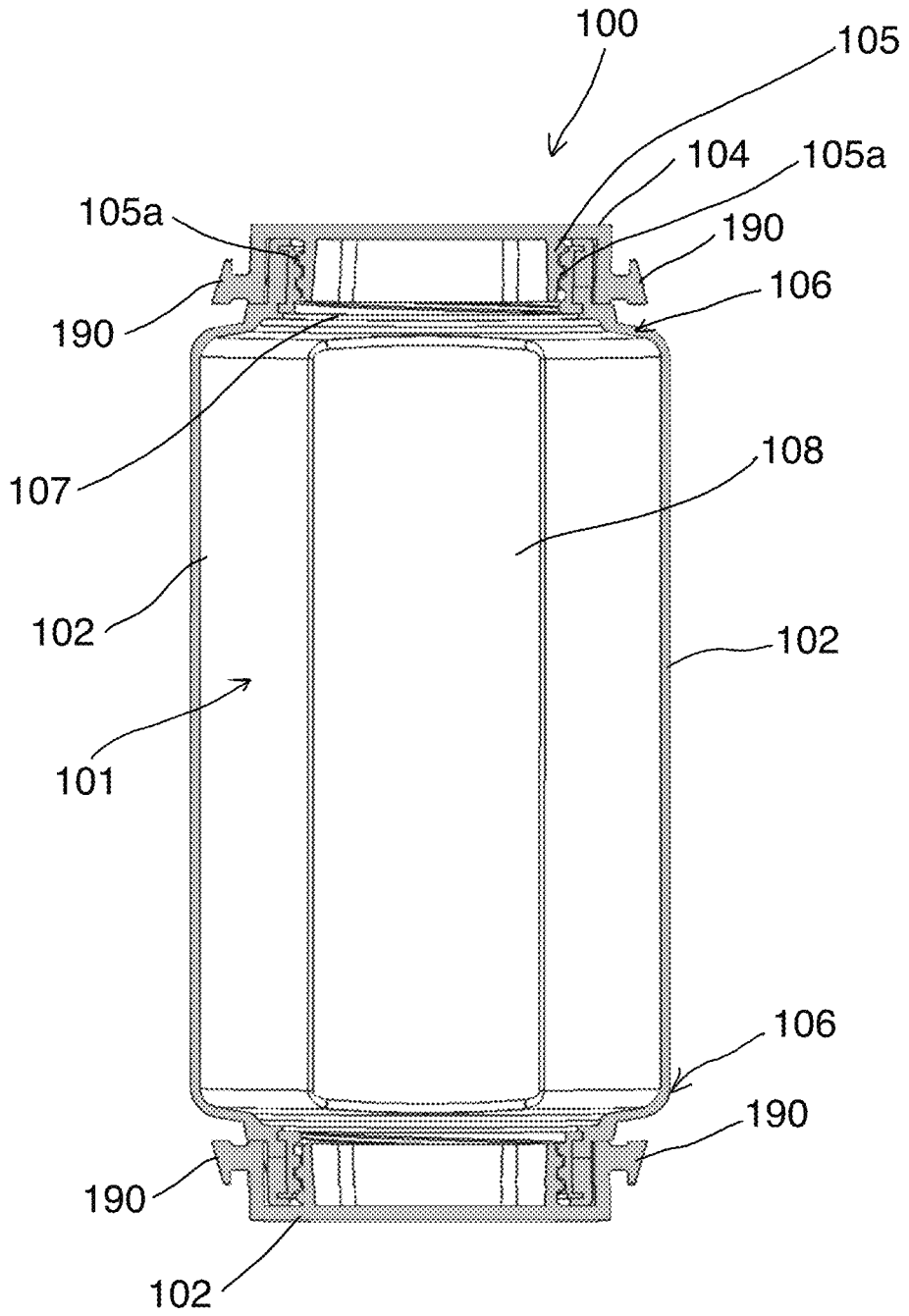
FIG. 3 is a cross-sectional view of a modular utility bottle having dual end caps, in accordance with embodiments of the present invention.
Figure 4:
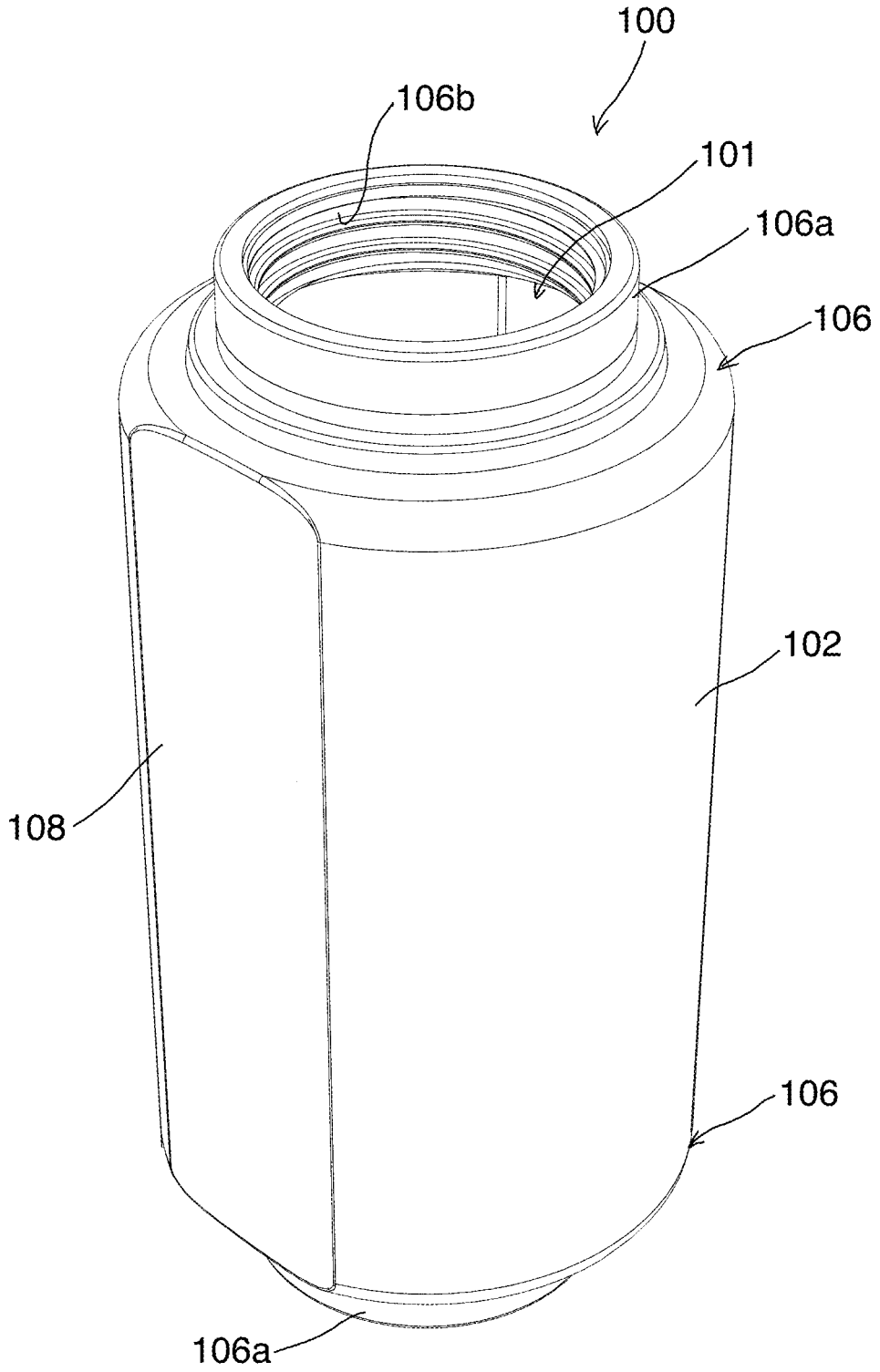
FIGS. 4-5 show a body portion of a modular utility bottle having opposing dual openings, in accordance with embodiments of the present invention.
Figure 5:
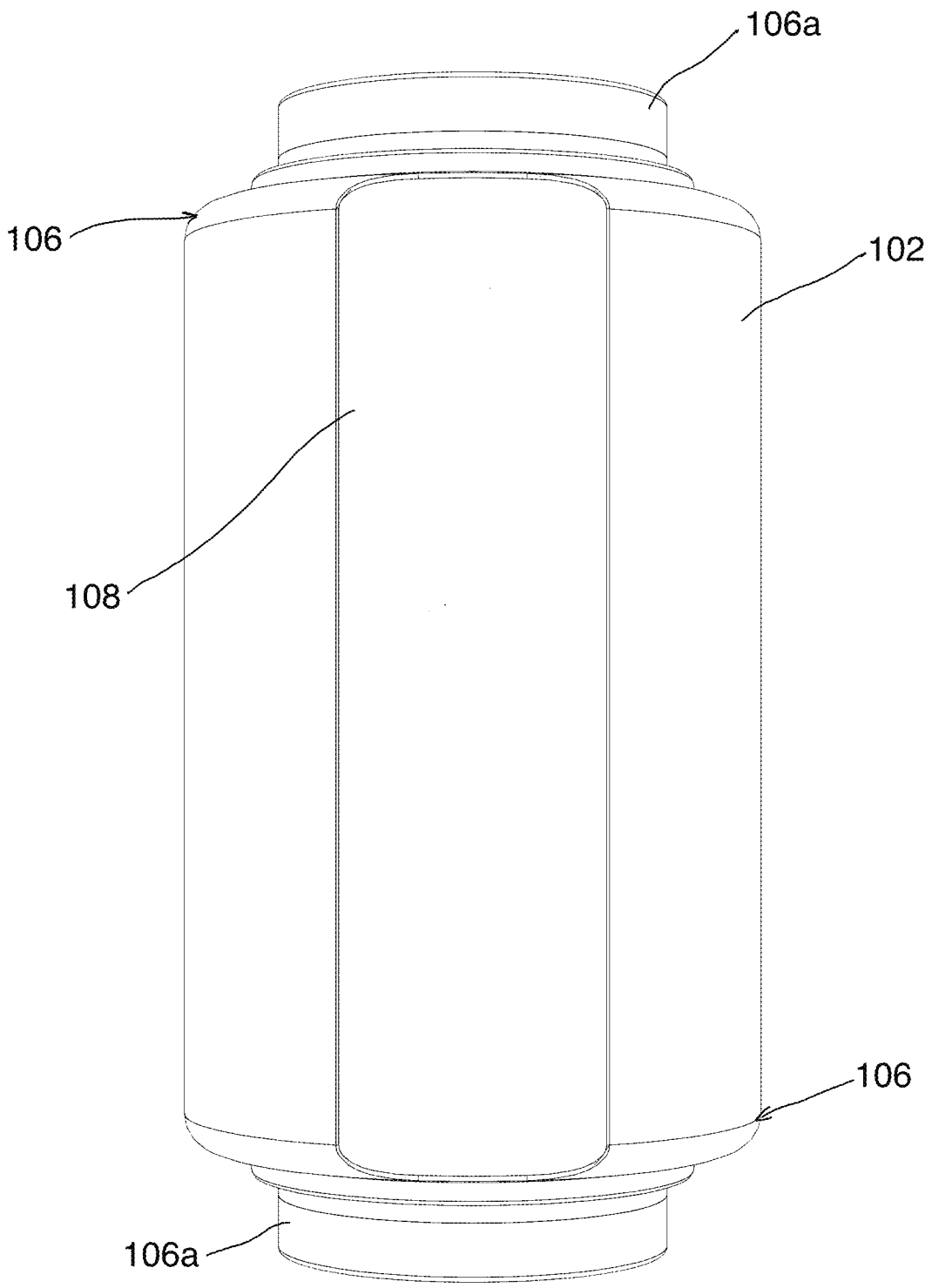
Figure 6:
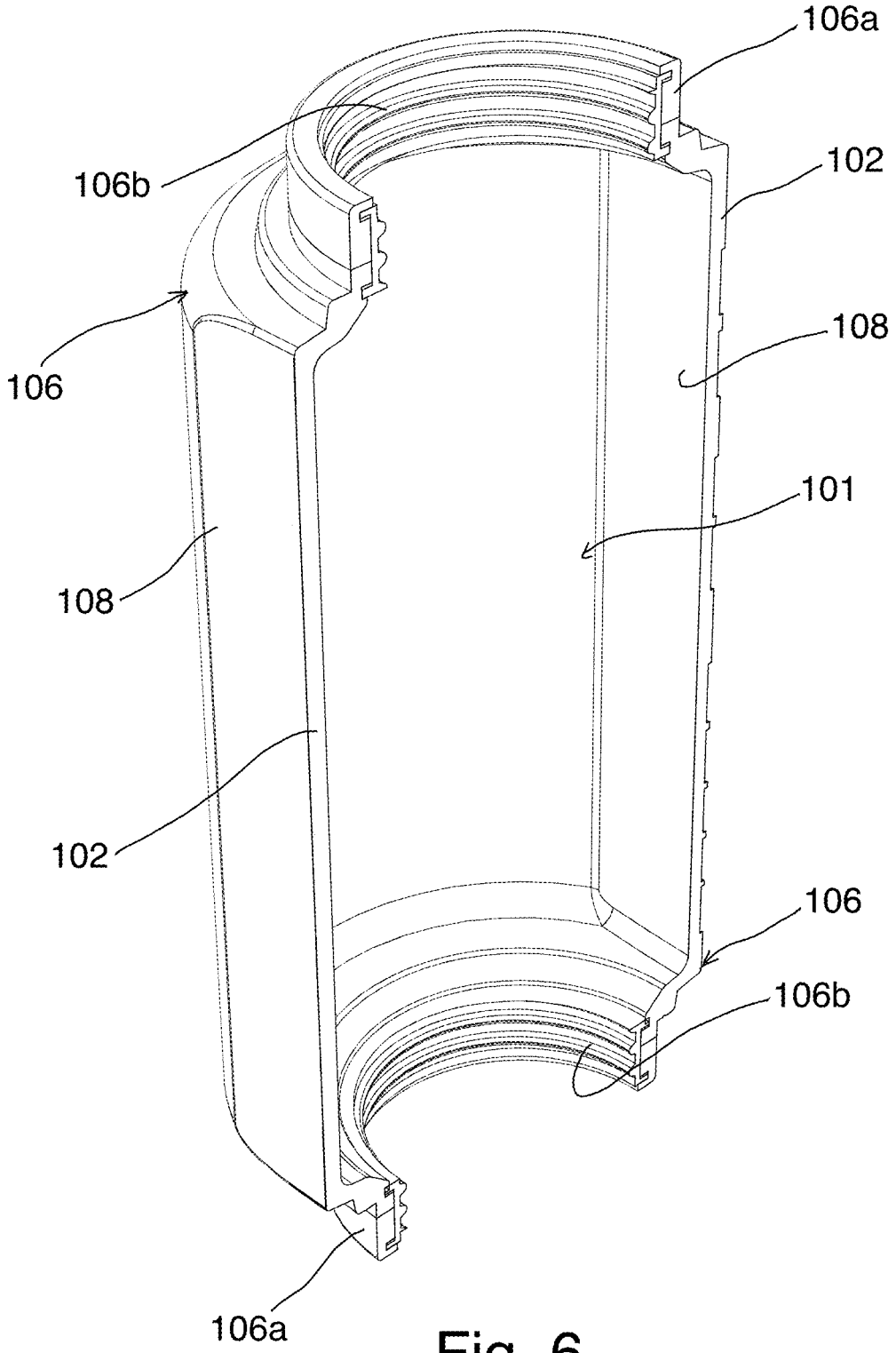
FIG. 6 is a cross-sectional view of body portion of a modular utility bottle having opposing dual openings, in accordance with embodiments of the present invention.
Figure 7:
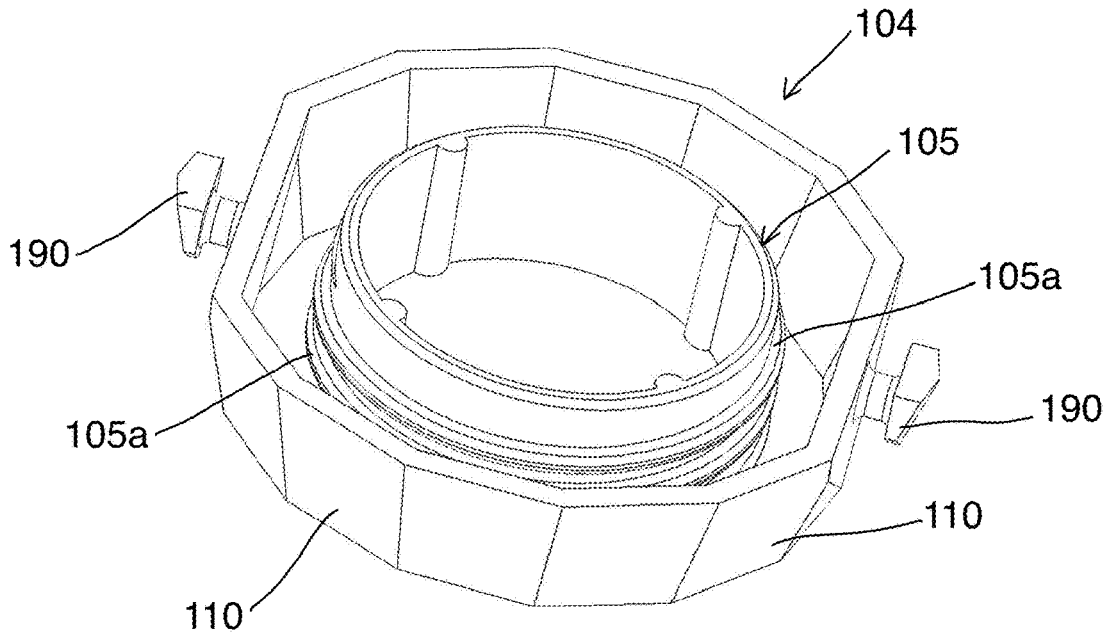
FIGS. 7-9 show a base end cap for use with a modular utility bottle, in accordance with embodiments of the present invention.
Figure 8:
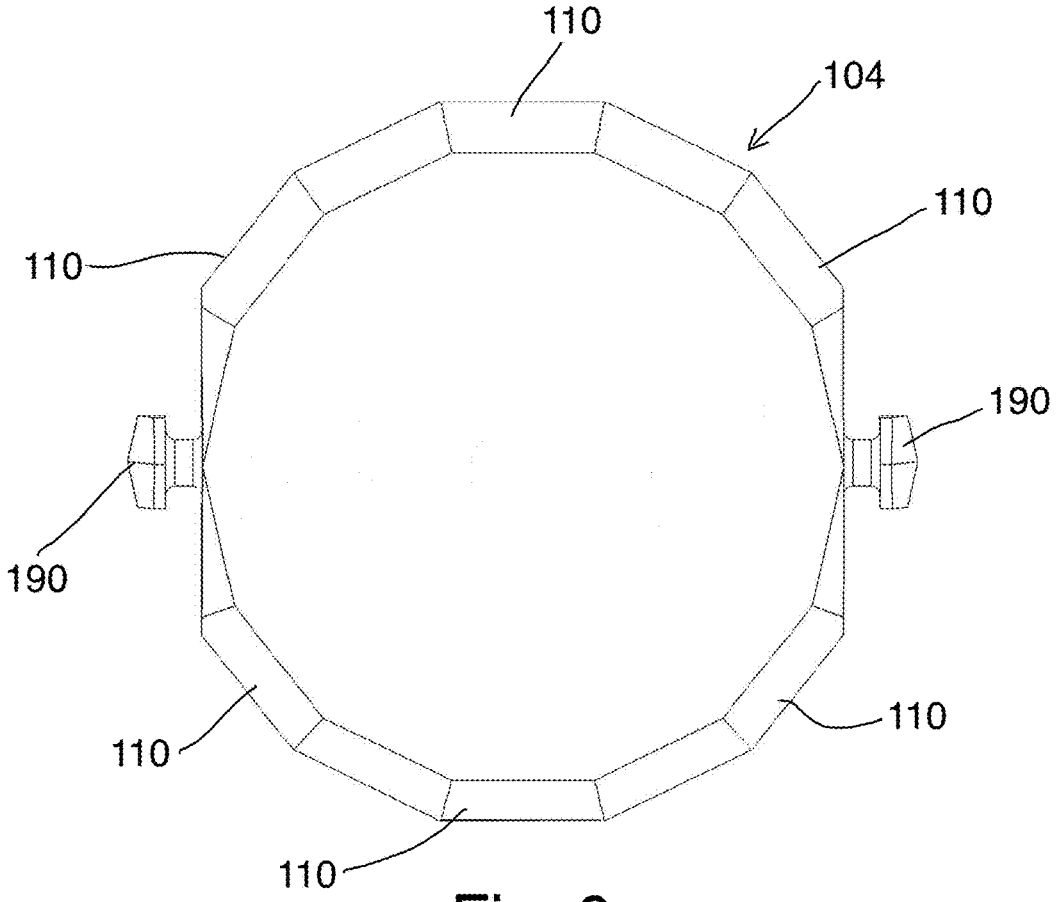
Figure 9:
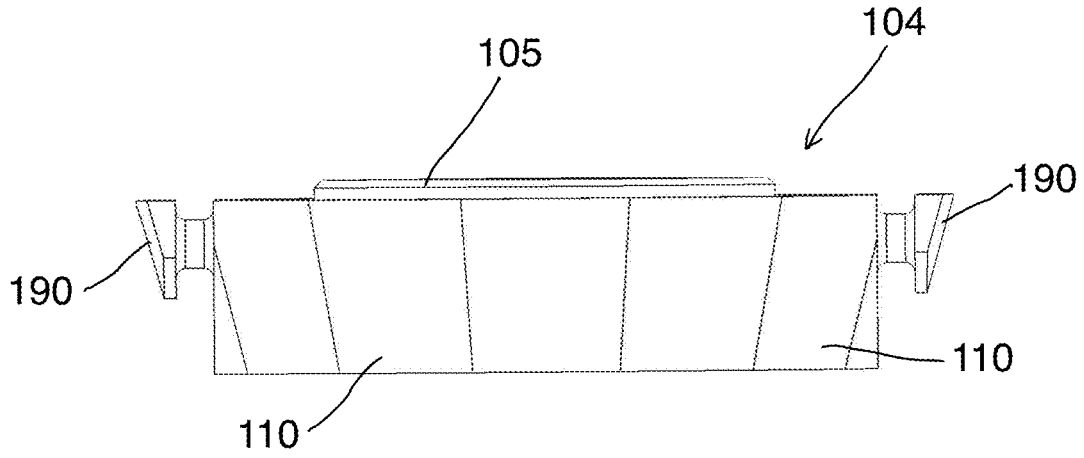
Figure 10:
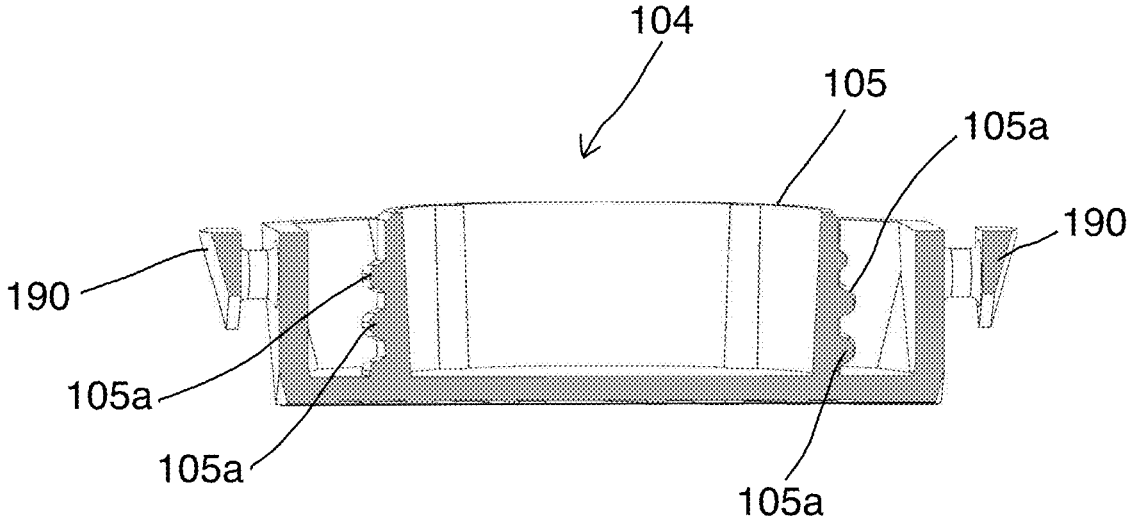
FIG. 10 is a cross-section view of a base end cap for use with a modular utility bottle, in accordance with embodiments of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the invention is to cover all modifications, equivalents, and alternatives falling within the spirit and scope of the invention as defined by the appended claims.

DETAILED DESCRIPTION

Referring generally to FIGS. 1-41, a modular utility bottle 100 (e.g., for holding liquid or dry storage contents) and its various assemblies, accessories, components, structures are provided. The bottle 100 is a multi-faceted and modular bottle configured to be particularly useful for hikers, campers, cyclists, climbers, pet owners, and the like. The bottle 100 is a double-ended device capable of being modified or expanded with various caps, accessories, filters, infusers, purifiers, and the like.

Referring to FIGS. 1-31, various embodiments of the bottle 100 of the present invention are shown. The bottle 100 can include a body portion 102 and one or more end caps as described herein. The body portion 102 includes an interior cavity or region 101 and end regions 106 having an opening and adapted to facilitate component attachment, and one or more side longitudinal flat regions 108. The regions 108 are provided to create an easy-to-grip surface and minimize or prevent rolling of the bottle 100 when placed on the ground or other surfaces. The body portion 102 can be constructed of a generally flexible material, such as silicone rubber or other like materials, that can be collapsed, compressed, or flattened or manipulated into other shapes to facilitate storage, transportation, cleaning, use as a bowl, and use in other forms. Applying pressure or squeezing on the bottle by the user can facilitate the expelling of fluid or other content from the bottle. Embodiments constructed of silicone rubber, or similarly beneficial materials, also provide a non-toxic bottle having desirable insulation characteristics, while being BPA free, hygienic, and hypoallergenic. In other embodiments, the body portion can be constructed of a rigid or semi-rigid material, such as metals (e.g., stainless steel), polymers, and the like. Further, the body portion can include a double-walled or like insulated construction.

Referring to the bottle 100 of FIGS. 1-10, the end caps can include base caps 104. The caps 104, and any of the caps disclosed herein, can include a peripheral edge having one or more flats 110 (e.g., angled or non-angled) configured to facilitate gripping and twisting of the cap 104. The caps 104 can further include an interior neck portion 105 having threading 105*a* adapted to threadably mate with the body 102 at the end regions 106. In particular, the end regions 106 can include an extending body neck 106*a* having internal threading 106*b* to threadably mate with the interior neck portion 105 and threading 105*a* of the cap 104.

The various caps of the present invention 100 can also include opposing knobs or like protruding elements 190 adapted to receive a portion of a loop member 192—see FIGS. 26-29—as detailed further below. Further, a ring (e.g., a stainless-steel ring) can be directly molded or otherwise applied to the extending silicone material of the neck end portion 106 of the bottle 100 to enhance quality, sealability, and durability of the cap (any of the caps disclosed herein) attachment structures and methods—see FIGS. 23-25.

Figure 11:
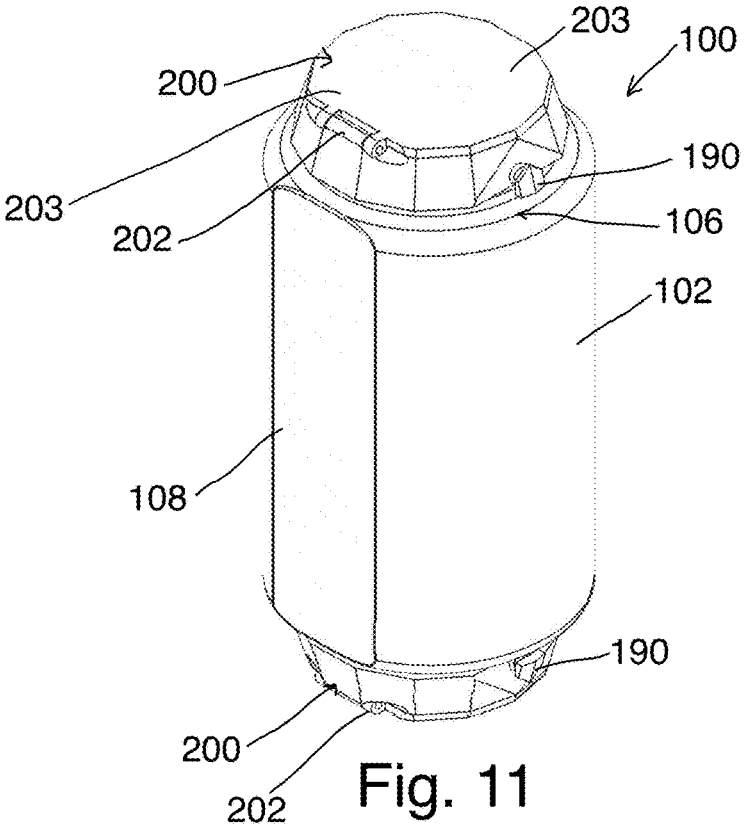
FIG. 11 shows a modular utility bottle having compartment caps on each end of the bottle, in accordance with embodiments of the present invention.
Figure 12:
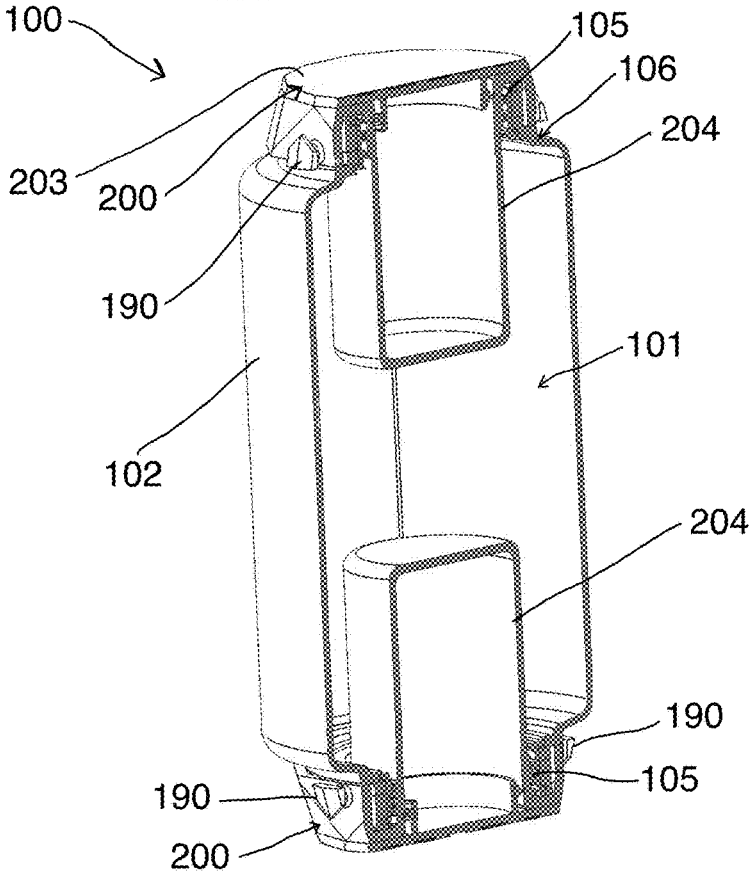
FIG. 12 is a cross-sectional view of the modular utility bottle of FIG. 11, in accordance with embodiments of the present invention.

FIGS. 11-12 depict a pack or container cap 200 for use with the bottle 100 to provide a dry storage option. The pack cap 200 can include a hinge 202, a pivotable lid 203, and an interior compartment body 204 (e.g., cylindrical). The pack cap 200 can be secured at the end region 106 such that the compartment body 204 extends into and is sealed within the body 102 to provide a dry storage space (e.g., for food, powder, keys, monies, etc.) within the bottle 100. The compartment body 204 can take on various sizes and shapes.

FIGS. 13-25 show exemplary embodiments of caps for use with the bottle 100.

FIGS. 13, 16, and 20*a*-20*b* show a cap 210 having a barbed spout or spigot member 212. The spigot member 212 includes an internal channel extending through the member 212 such that is in direct fluid communication with the interior of the body 102 via portion 214. The spigot member 212 extends outside of the cap 210 to selectively receive various devices or accessories, such as external tubing, nozzles, conduits, mouth pieces, and the like, to facilitate the flow of fluid from the interior of the bottle 100 and out to a user. The barbed member 212 can include various structures and features 213 to facilitate the attachment of the various devices or accessories, including indentations, grooves, tapers, ledges, nubs, protrusions, narrowing, and other features. One or more valve devices 233 (e.g., a one-way valve), removable nozzles, and the like, can be included with or provided for attachment to the cap 210, and other caps disclosed herein, as detailed further with reference to FIGS. 21-25. In certain embodiments, a separate fluid or drinking nozzle is not required and the spigot member 212 itself can be used by the user to consume fluid from the bottle.

When attaching tubing or other conduits to the barbed spout 212, the user can conveniently drink from the bottle 100 without removing the cap, and without unclipping or removing the bottle 100 from a backpack, bike, etc. If tubing extends into the bottle interior 101, a weight can be included at the end of the tubing, within the bottle 100, to ensure that the end remains in contact or submersed within the fluid such that fluid can be sucked in and through the hose, no matter what the orientation of the bottle 100 is at the time. A water purifier may also be attached to the inside or outside of the cap 210 to facilitate personal water purification through straw-sucking action (purifier is inside the bottle) or for bulk water purification through gravity filtering (purifier hangs outside the bottle). For purification purposes, the bottle 100 can provide both personal water purification and purification for a group of people. For the group of people, the filter is connected via a hose on the outside of the bottle 100. The bottle 100 is hung up using a loop (e.g., 192 or 132) on the opposite side of the purifier, such that the purifier hangs down and water is pulled by gravity through the filter and drips out for purification without multiple people having to drink from one bottle 100.

FIGS. 14, 17, and 19*a*-19*b* show a rinse cap 220 having a plurality of small apertures 222 defined therein such that tipping the bottle 100 upside down (and even applying pressure or squeezing on the body 102) causes the cap 220 to act as a shower head, a liquid rinsing container, etc. The size, shape, and number of apertures 222 can vary to alter the amount and pattern of fluid flowing from the cap 222.

Figures 13, 14, 15:
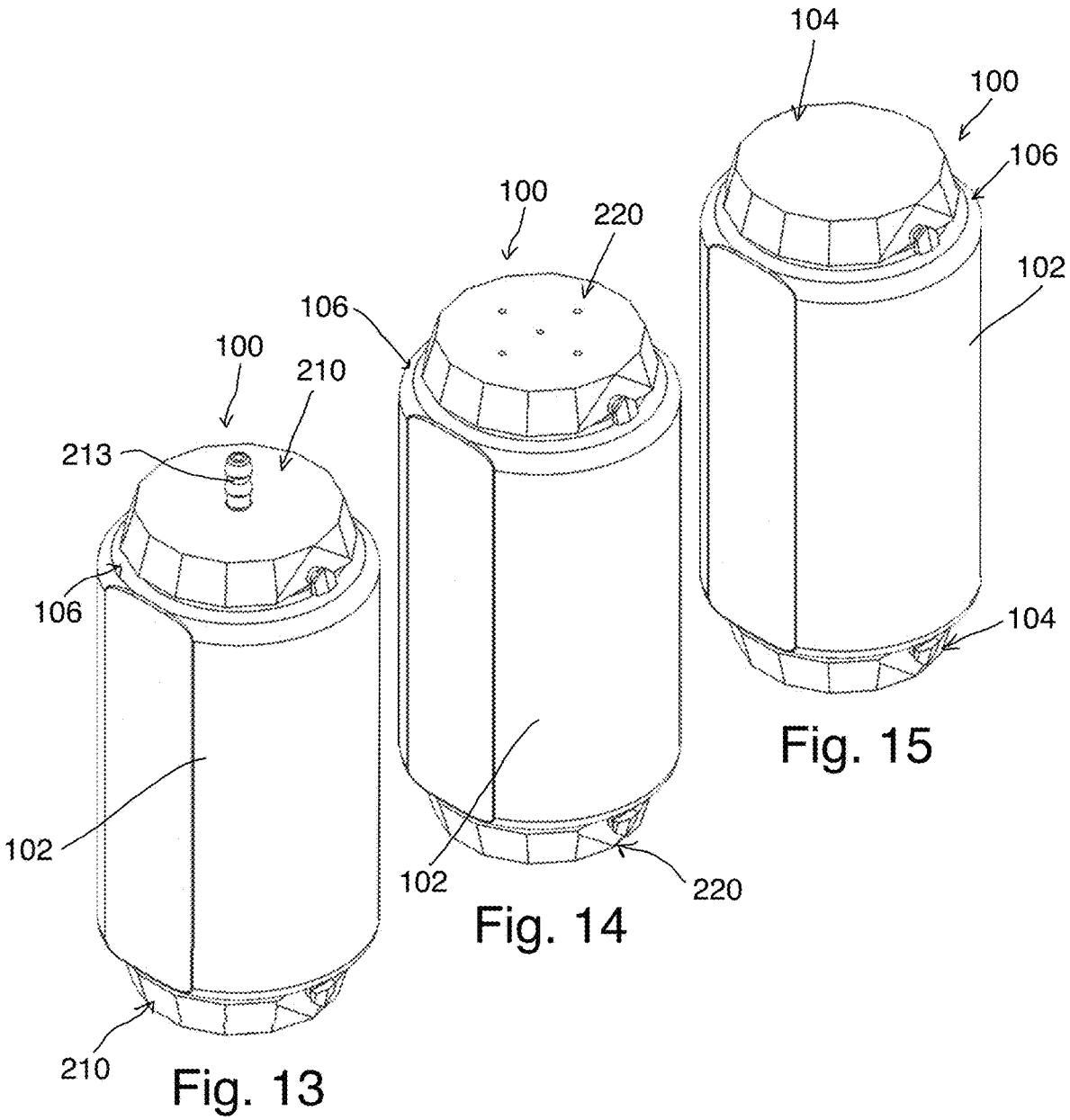
FIG. 13 shows a modular utility bottle having barbed or spigot caps, in accordance with embodiments of the present invention.
FIG. 14 shows a modular utility bottle having a rinse cap having a plurality of apertures, in accordance with embodiments of the present invention.
FIG. 15 shows a modular utility bottle having a base cap, in accordance with embodiments of the present invention.
Figure 16:
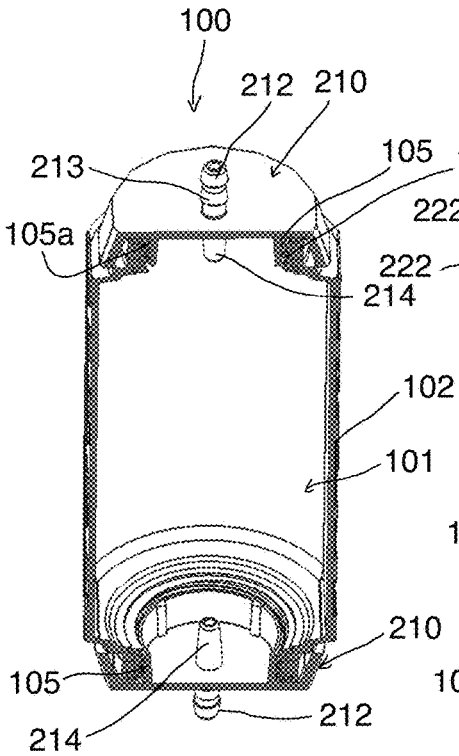
FIG. 16 is a cross-sectional view of the modular utility bottle of FIG. 13.
Figure 17:
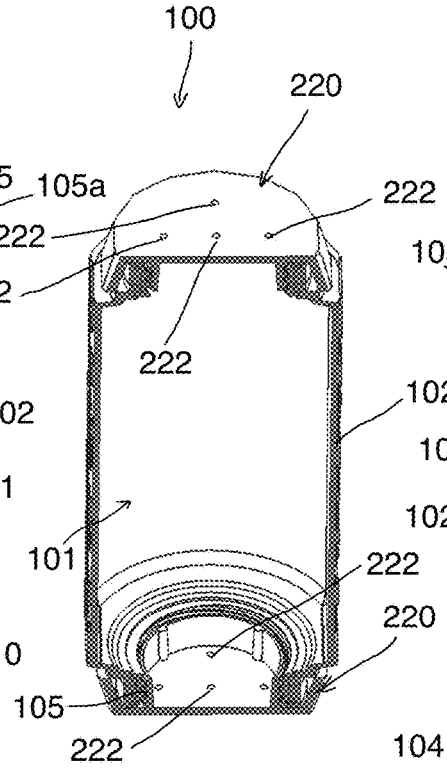
FIG. 17 is a cross-sectional view of the modular utility bottle of FIG. 14.
Figure 18:
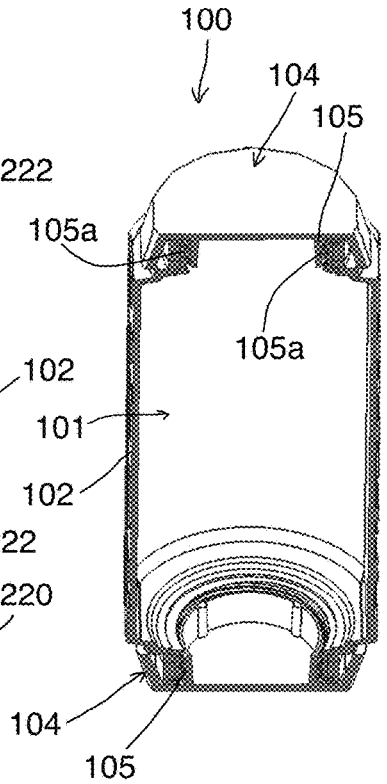
FIG. 18 is a cross-section view of the modular utility bottle of FIG. 15.
Figure 19A:
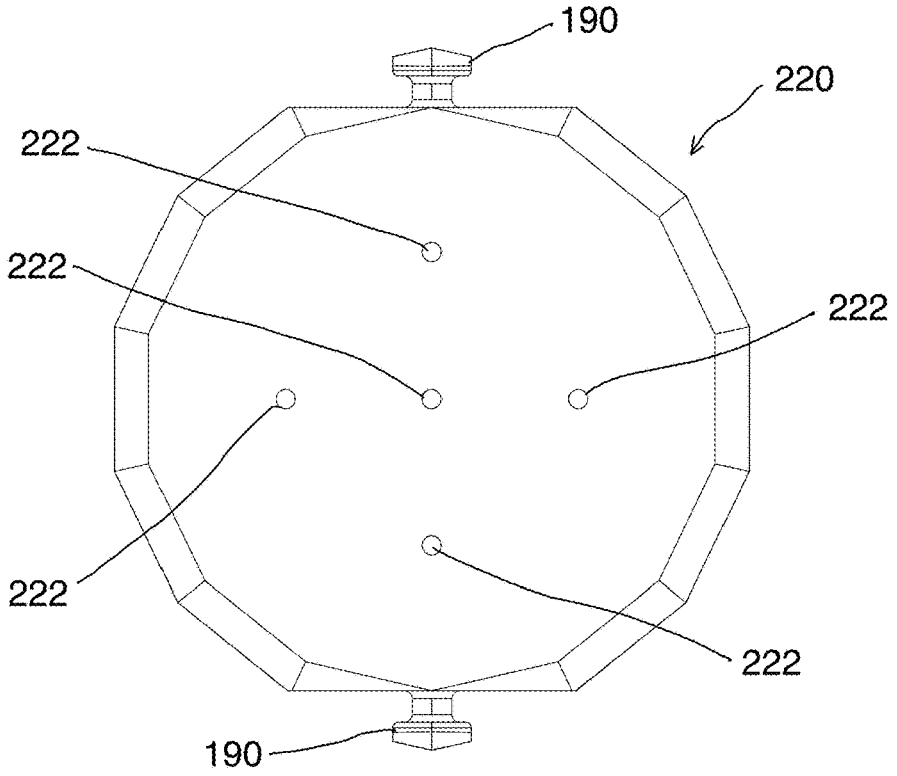
FIGS. 19*a*-19*b* show a rinse cap for use with a modular utility bottle, in accordance with embodiments of the present invention.
Figure 19B:
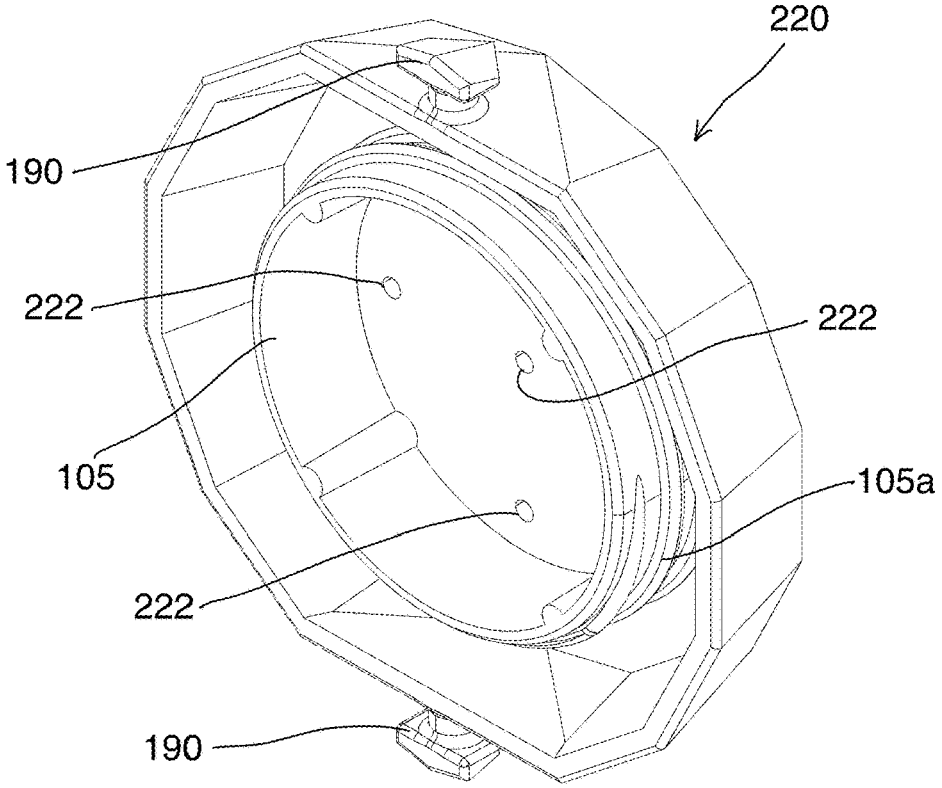
Figure 20A:
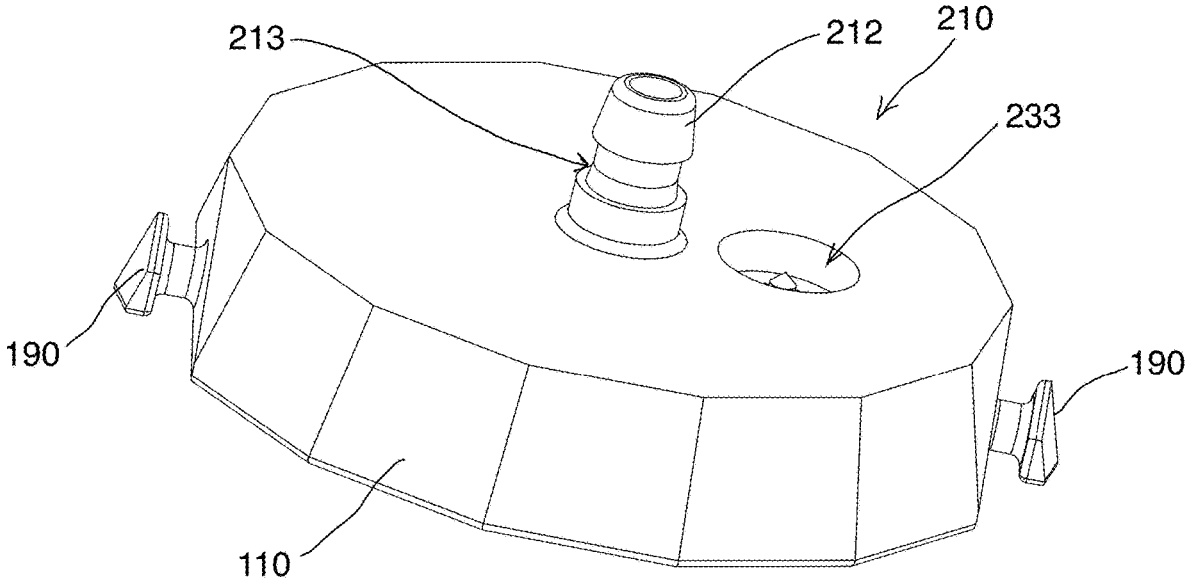
FIGS. 20*a*-20*b* show a multi-purpose cap having a barbed member and a valve device, in accordance with embodiments of the present invention.
Figure 20B:
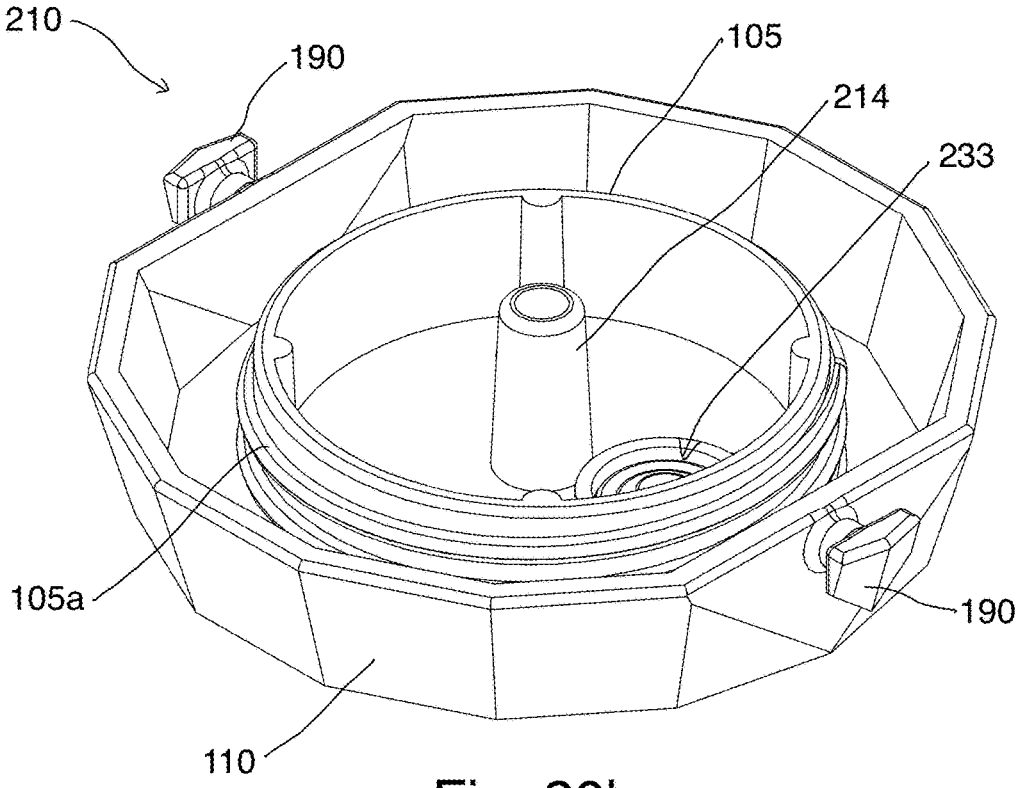
Figure 21:
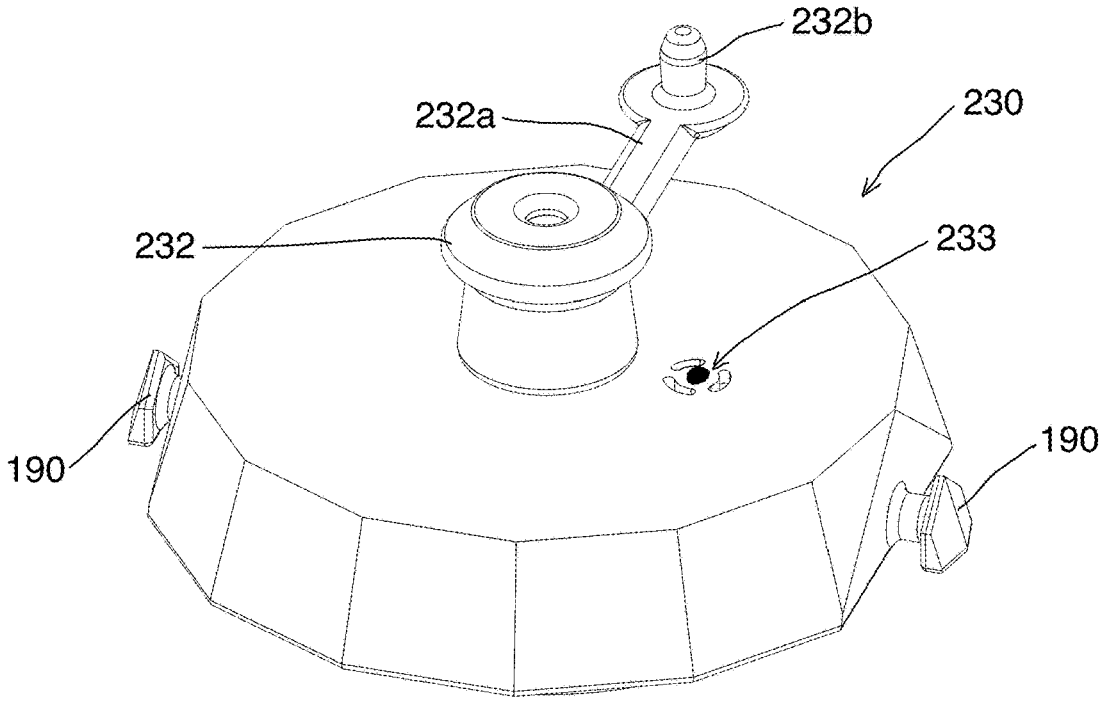
FIGS. 21-24 show a fluid nozzle cap for use with a modular utility bottle, in accordance with embodiments of the present invention.
Figure 22:
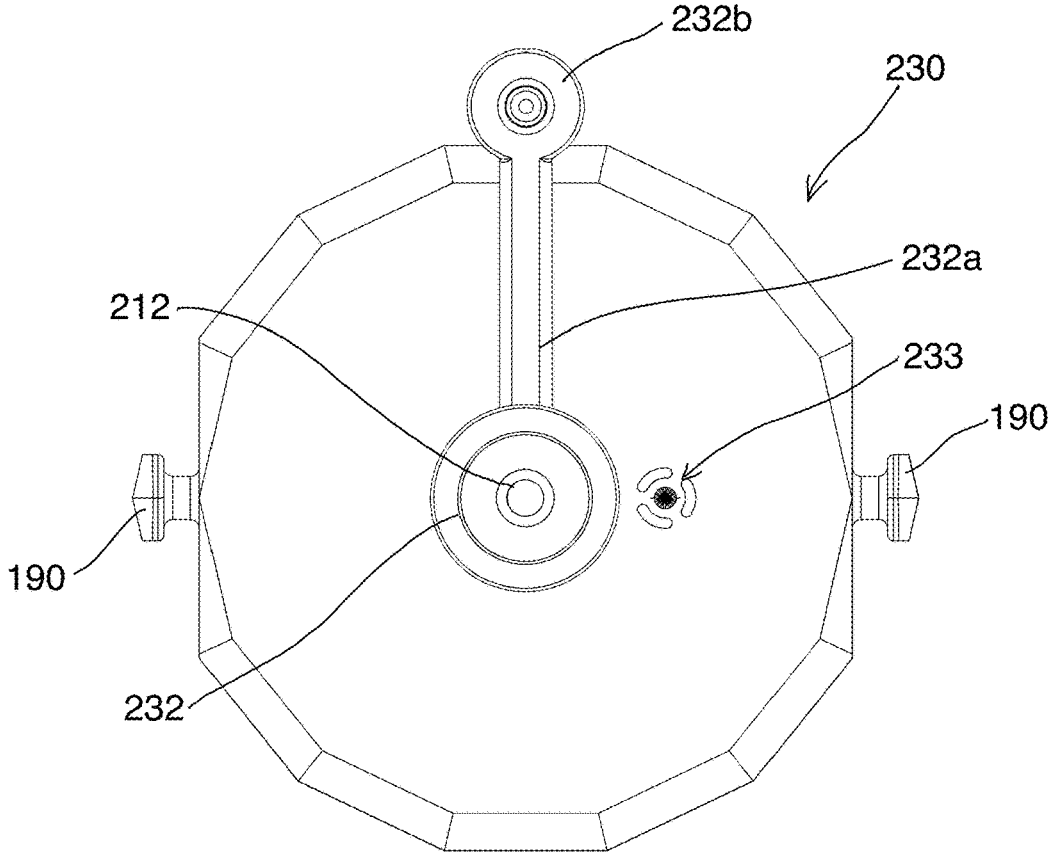

FIGS. 15 and 18 show a bottle 100 having the removable base cap 104.

FIGS. 21-25 show a cap 230 having an attachable nozzle for use with the bottle 100 (e.g., positioned on the barbed spigot cap 210). The cap 230 can include a fluid nozzle or mouthpiece 232 selectively connectable to (e.g., pop, snap, or slide on), and removable from, the barbed spout member 212. The nozzle 232 includes a central aperture such that the fluid exiting the spout member 212 also exits through the top of the nozzle 232. Extending from the nozzle 232 is a flexible arm section 232*a* and a stopper or plug 232*b*. These components can be constructed at least in part of a silicone rubber material. The plug 232*b* can be inserted through the top aperture of the nozzle 232 and into the fluid channel of the barbed member 212 to restrict the flow of fluid through the barbed member 212. The plug 232*b* is removed to permit fluid flow. This cap 230 can further include a one-way valve 233, such as an "umbrella valve." The valve 233 permits air in from the outside of the bottle 100 but does not let water escape, even when pressurized. Various other types of one-way valves and valve constructs can be employed without deviating from the spirit and scope of the present invention.

Figure 23:
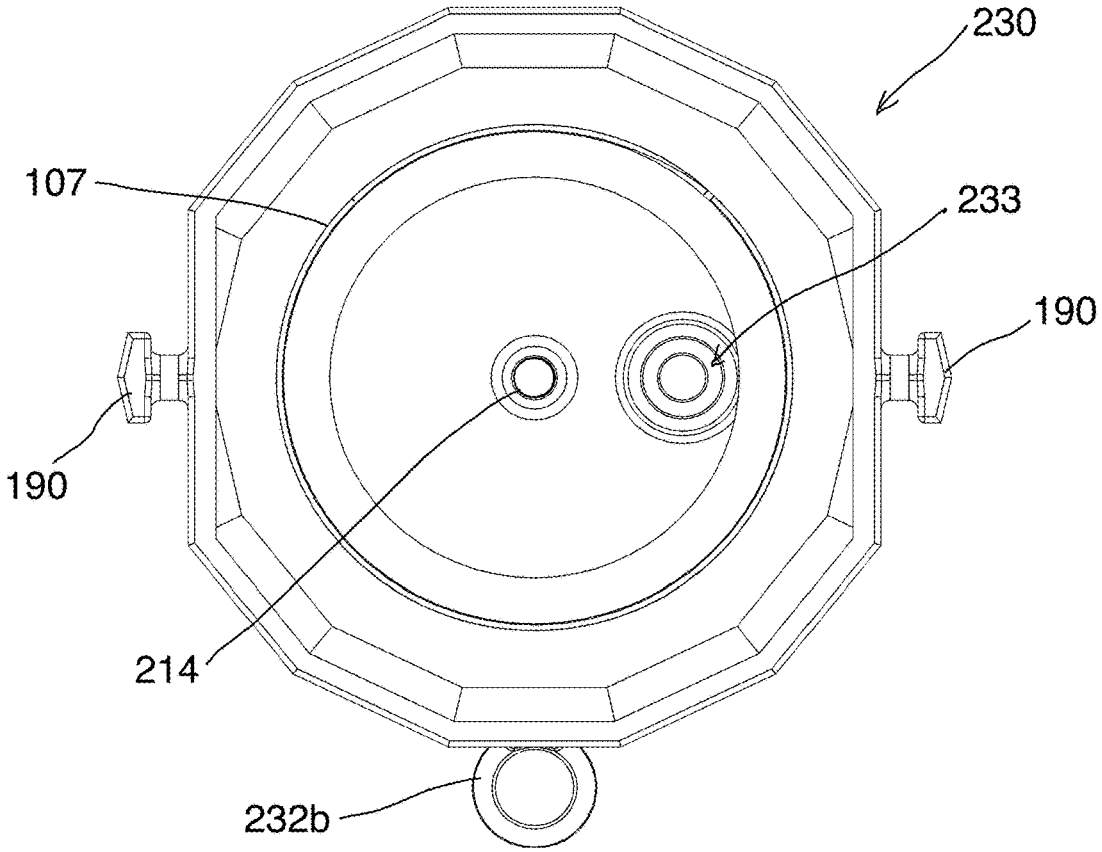
Figure 24:
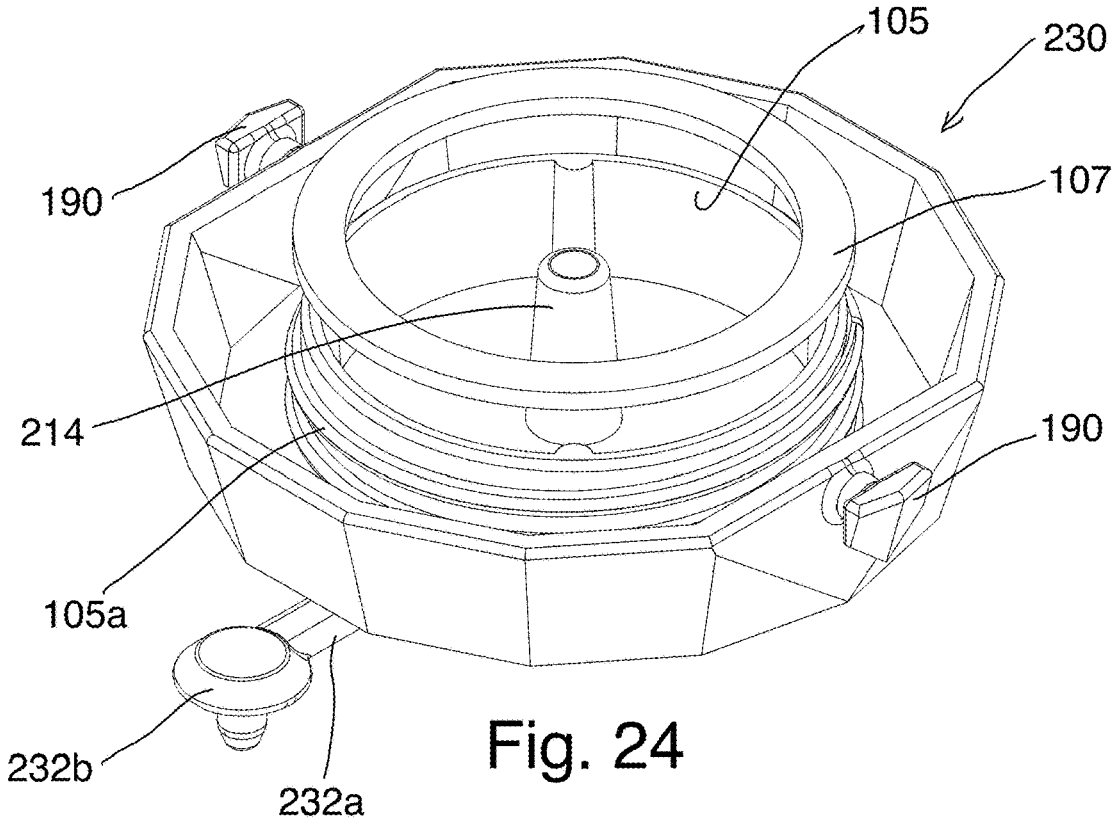
Figure 25:
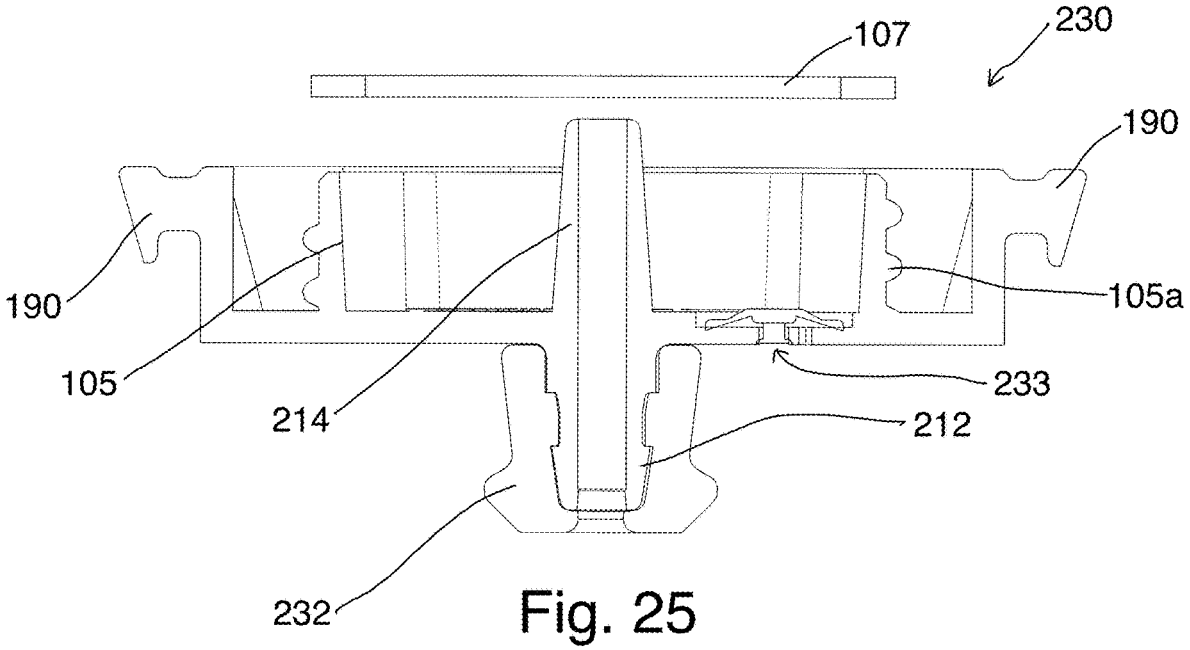
FIG. 25 is a cross-sectional view of a fluid nozzle cap for use with a modular utility bottle, in accordance with embodiments of the present invention.
Figure 26:
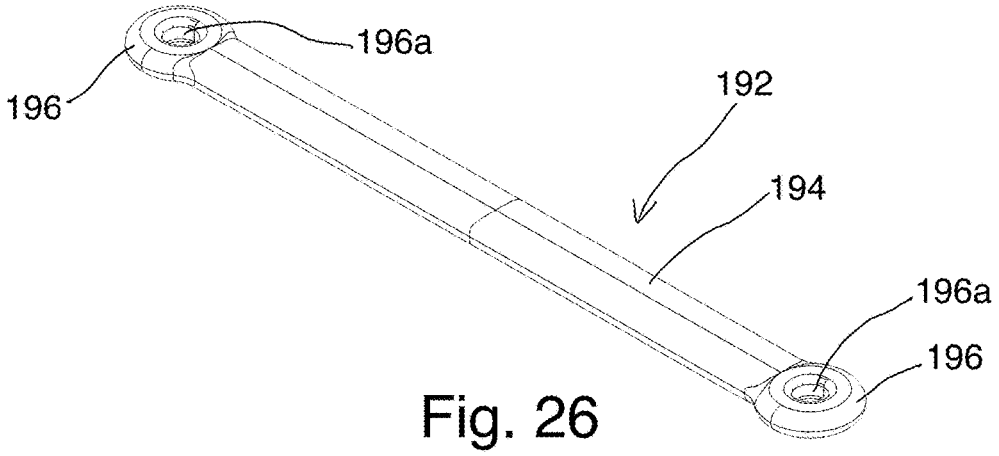
FIGS. 26-29 show loop members for use with a modular utility bottle, in accordance with embodiments of the present invention.
Figure 27:
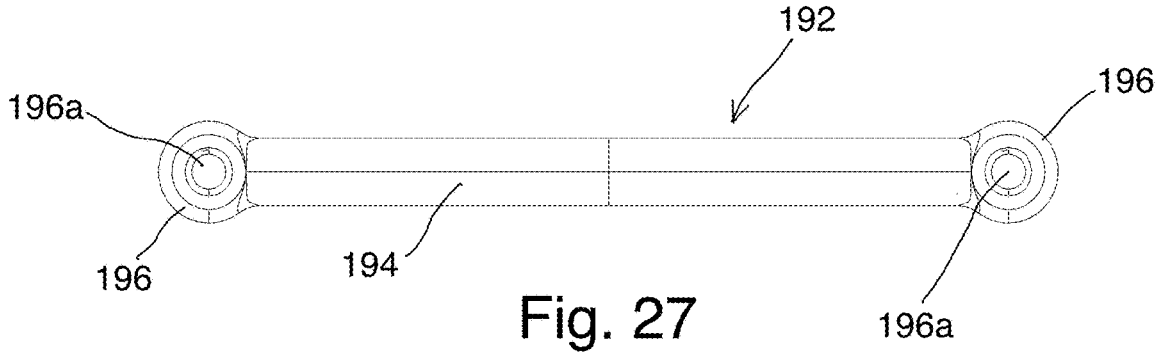
Figure 28:
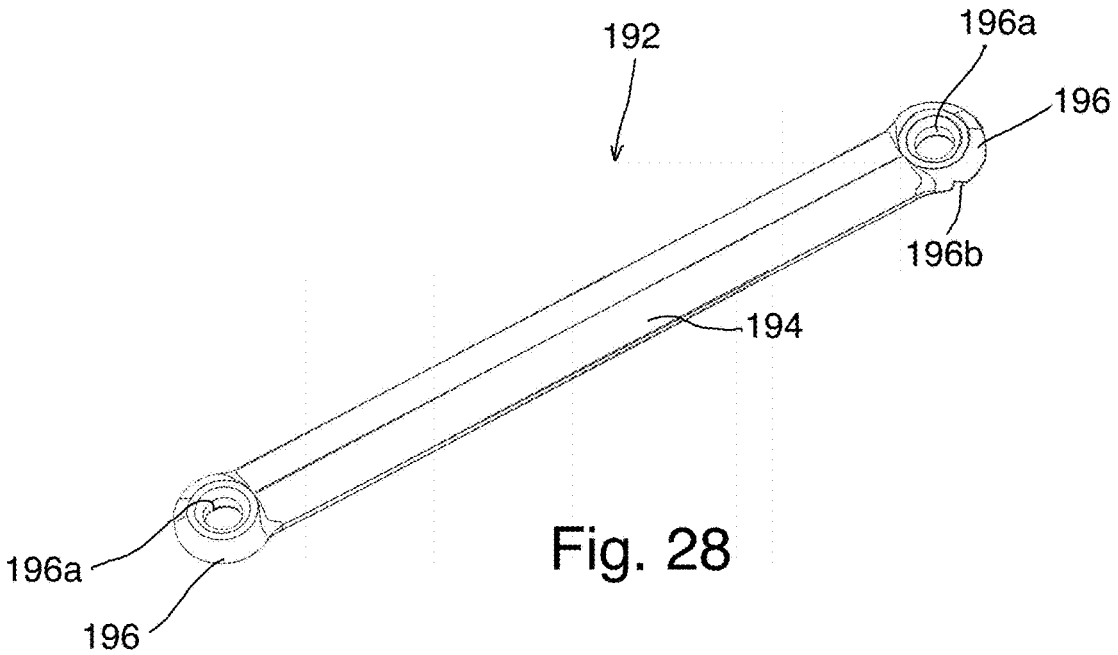
Figure 29:
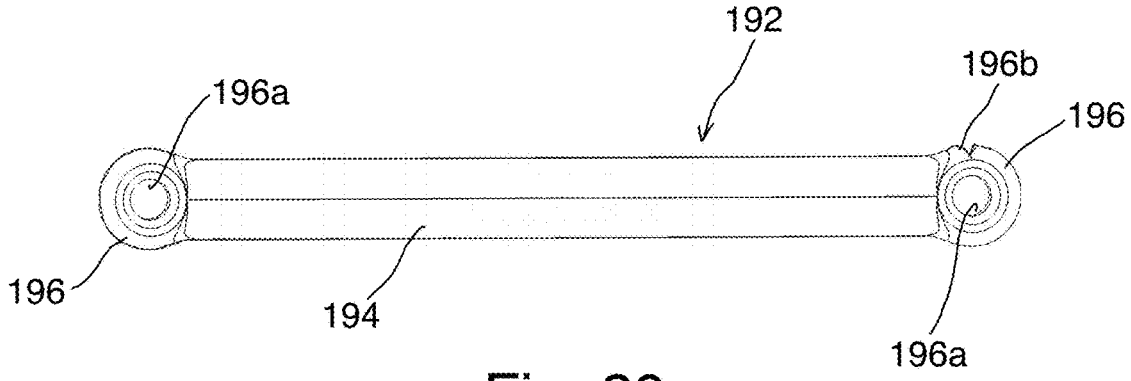

A ring (e.g., a stainless-steel ring) or gasket 107 can be directly molded or otherwise applied to the extending silicone material of the neck end portion 106 of the bottle 100 to enhance quality, sealability, and durability of the cap attachment structures and methods, as shown in FIGS. 23-25. The gasket 107 also provides indexing or positioning/alignment of the knobs 190 when the bottle 100 is closed.

Figure 30:
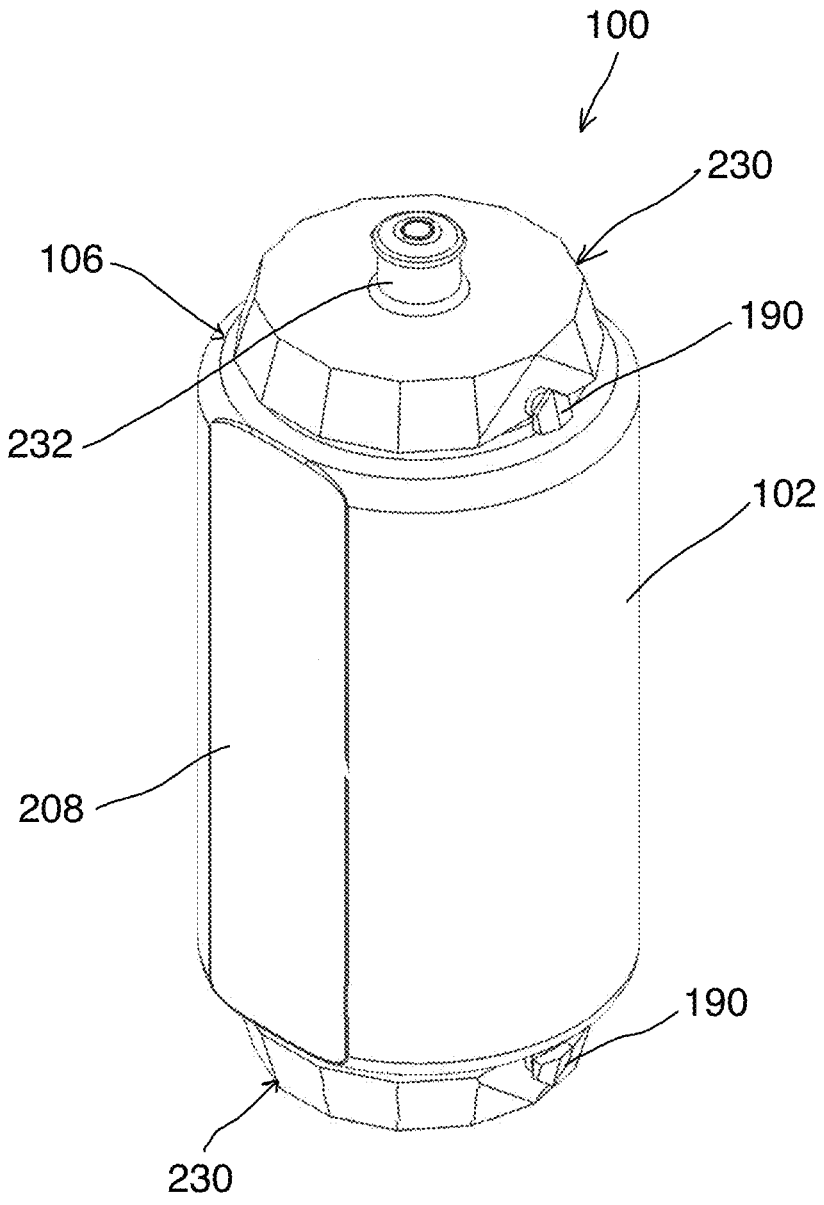
FIG. 30 shows a modular utility bottle having fluid nozzle caps, in accordance with embodiments of the present invention.
Figure 31:
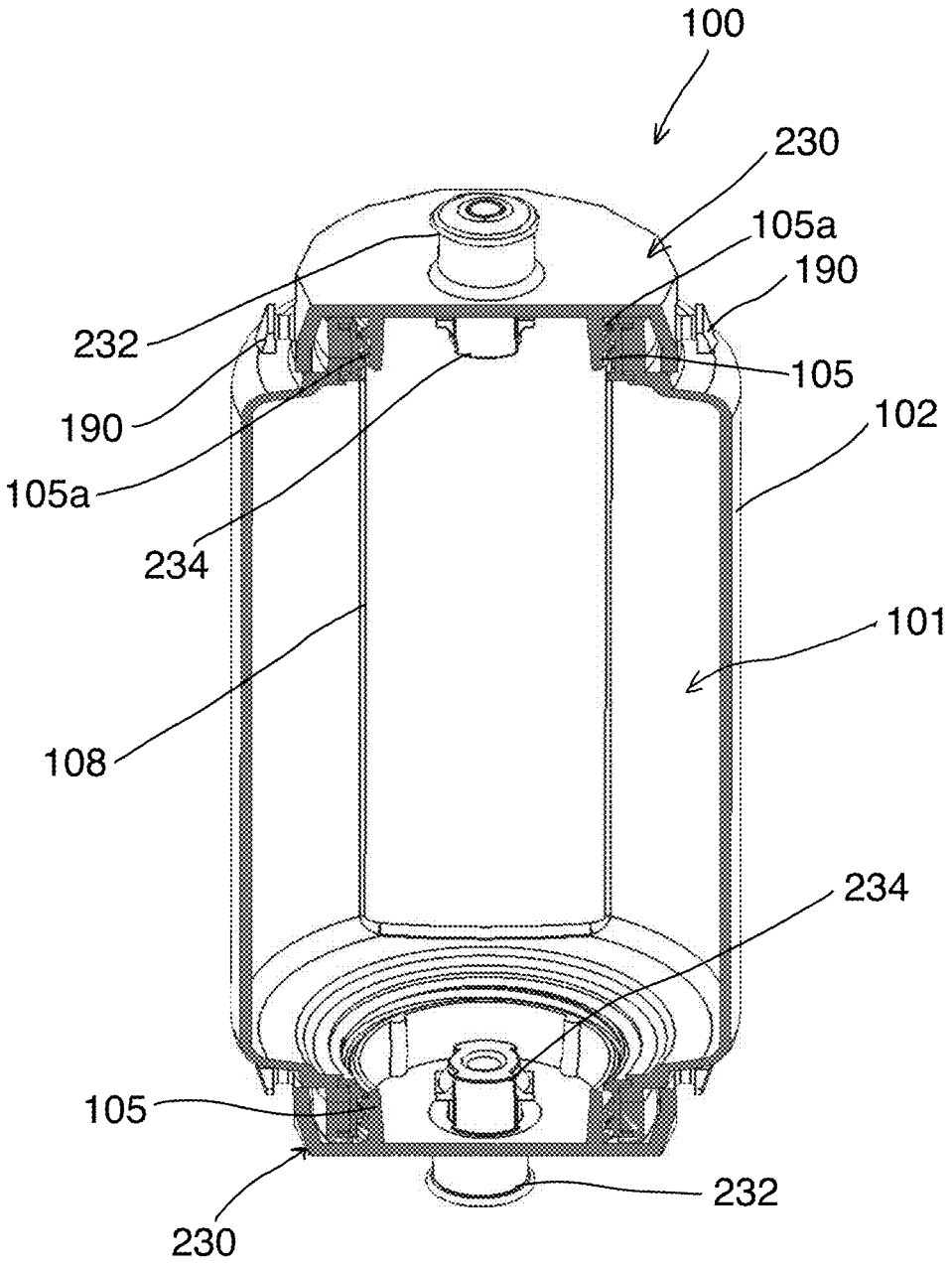
FIG. 31 is a cross-sectional view of the modular utility bottle of FIG. 30.
Figure 32:
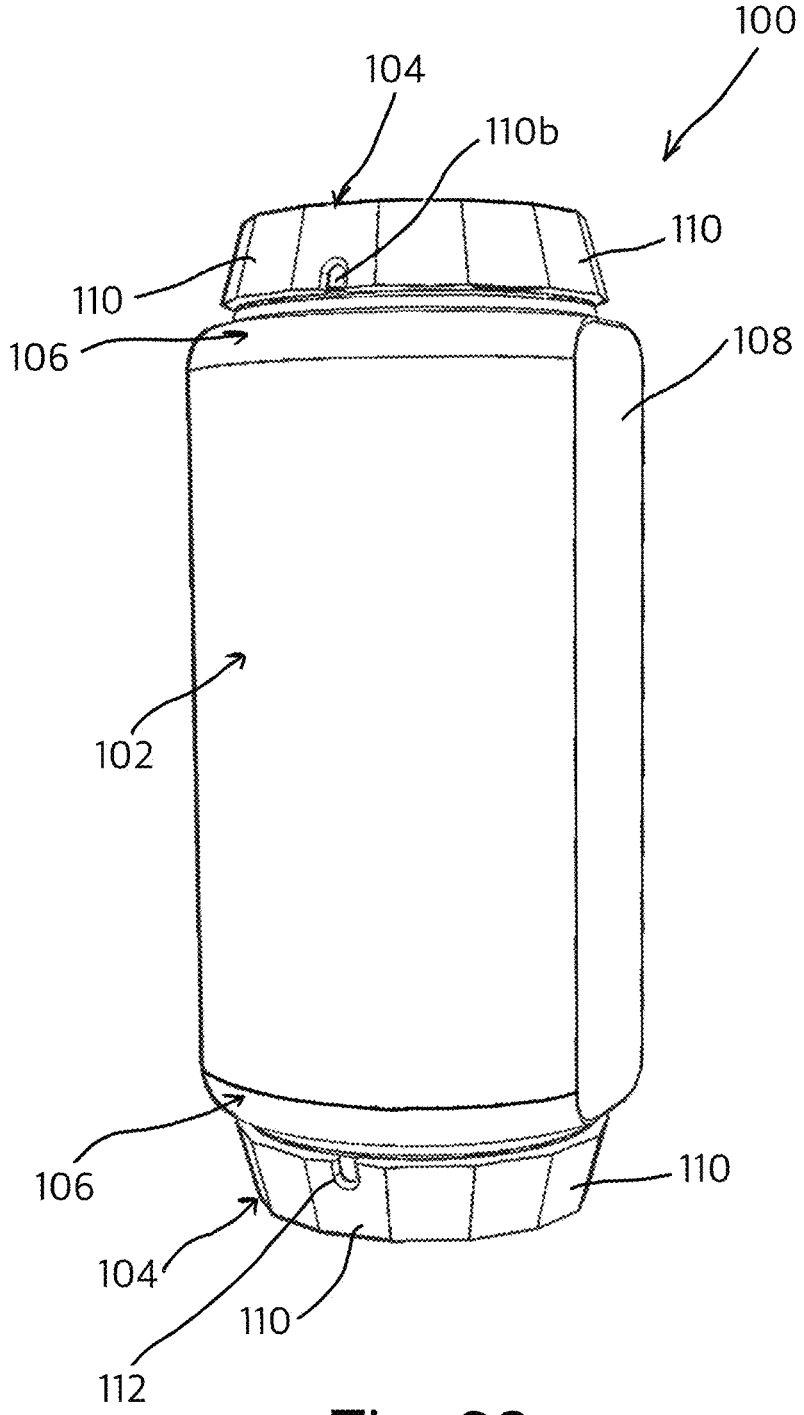
FIG. 32 shows a modular utility bottle having opposing dual end caps, in accordance with embodiments of the present invention.
Figure 33:
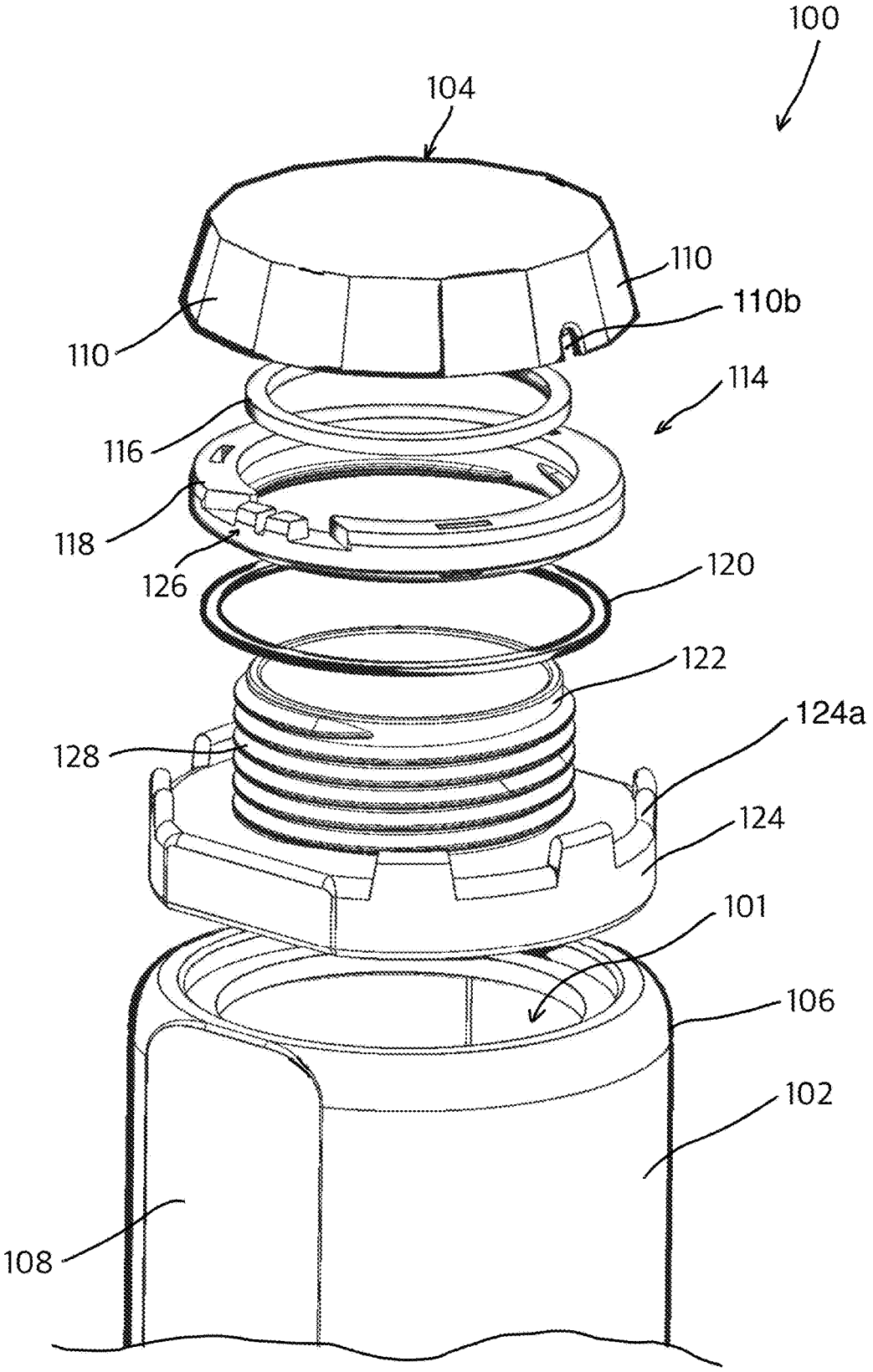
FIG. 33 is an exploded view of an end portion assembly of a modular utility bottle, in accordance with embodiments of the present invention.

FIGS. 30-31 show another embodiment of a sport like cap 230, where the fluid nozzle 232 is integrated into the cap rather than selectively added for use with the spout member 212 and cap 210, as is the case with the embodiment of FIGS. 21-25. With such embodiments, the cap 230 includes the liquid nozzle 232 having a stem portion 234 in direct fluid communication with the interior of the body 102. Various embodiments of the nozzle 232 can be configured as "pop-up" nozzles, can include fluid flow control features, valve features, and the like, to facilitate drinking or otherwise expelling liquid from the bottle 100—e.g., upon the application of a squeezing force to the flexible body portion 102.

FIGS. 26-29 depict embodiments of the flexible loop member 192 that can be included with any of the embodiments of the present invention. The loop 192 includes opposing end apertures 196*a* and a main body portion 30. The loop 192 can be constructed of a silicone rubber material such that it is stretchable over the knobs 190 on each side of the respective cap to define a bottle carrying handle. The ends of the loop 192 can include a wedge cutout or slit 196 (e.g., FIGS. 28-29), with the end apertures 196*a* sized and shaped to selectively but securely engage around the cap knobs 190. When not in use, a free end of the loop 192 can be rotated or turned (e.g., 90 degrees) from an upright position and stretched along the side of the bottle body 102 for attachment to the opposing cap and knob 190 for out-of-the-way storage. Further, because the loop 190 is easily stretchable and removable, there is no need for a carabiner, or like devices, to secure, handle, or carry the bottle 100. Instead, the loop 190 is adapted to loop around structures to facilitate attachment, placement, hanging, securement, etc. for the bottle 100.

Various embodiments of the bottle 100, and the body 102 in particular, can include one or more rib support members or elements. These support elements can be provided on the inside of the body 102 to alter the feel of the bottle 100 and to provide a degree of structural rigidity along select portions of the body 102 (e.g., concentrically at the middle of the cylindrical body 102, or radially or longitudinally at any portion of the body 102).

Due to the silicone material used in forming embodiments of the bottle 100, the top half, or other portions, of the bottle 100 can be collapsed for storage and handling, and can be collapsed to form various shapes, including a bowl shape. As a bowl, the collapsed bottle 100 can be used to eat out of while camping, used by pets to drink or eat from, etc.

Figure 34:
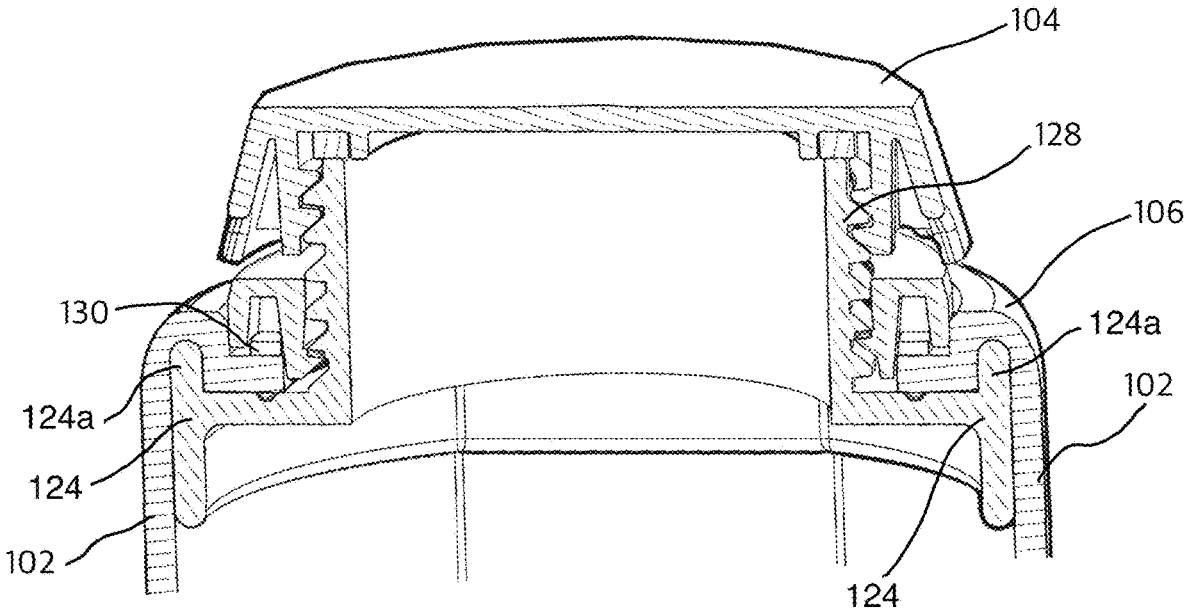
FIG. 34 is a cross-sectional view of an end portion assembly of a modular utility bottle, in accordance with embodiments of the present invention.
Figure 35:
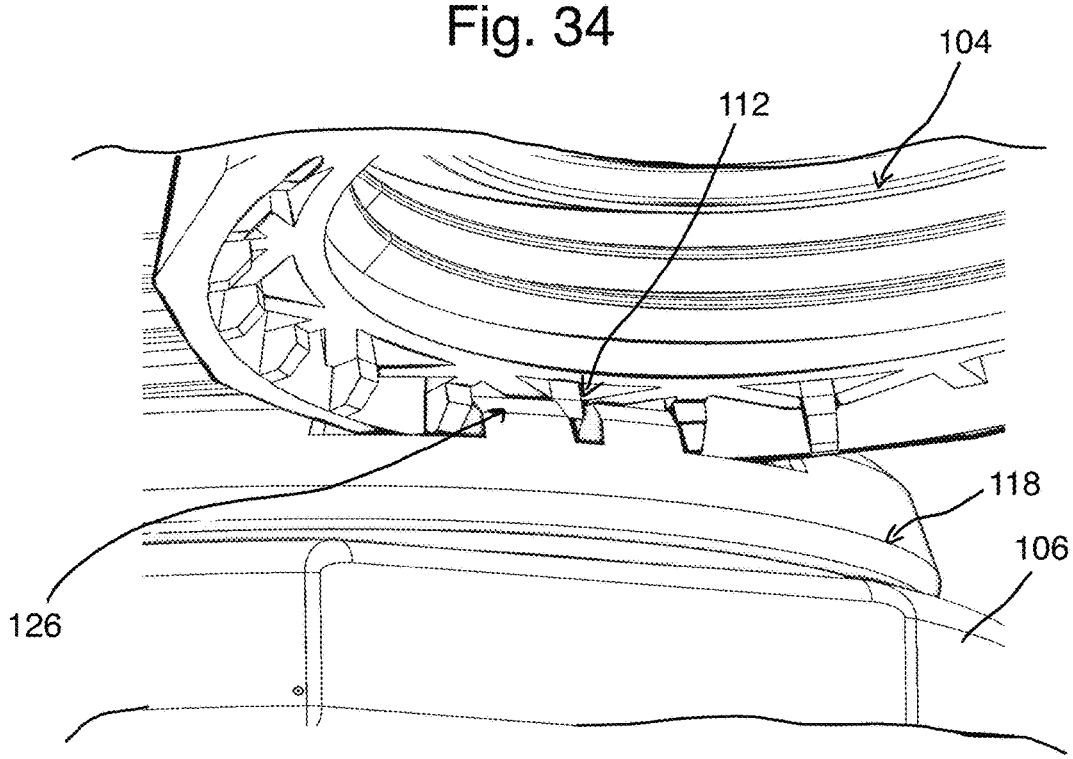
FIG. 35 is a closeup view of a cap and nut adjustment for a modular utility bottle, in accordance with embodiments of the present invention.

Various other embodiments of the bottle 100, caps, accessories, and components are shown in FIGS. 32-41. The bottle 100 of FIGS. 32-35 can include an end assembly 114. The end assembly 114 can include a gasket 116 (e.g., silicone), a nut 118 (e.g., polypropylene), a washer 120 (e.g., Delrin washer), and a mouthpiece 122 (e.g., polypropylene). As detailed in the exploded view of FIG. 33, the gasket 116, nut 118, and washer 120 are disposed intermediate the mouthpiece 122 and the cap 104. The gasket 116 can snap or otherwise engage within the cap 104 and is provided to create a seal between the mouthpiece 122 and the cap 104. The washer 120 can snap or otherwise engage with the nut 118. The nut 118 is provided to hold the mouthpiece 122 in place and for engaging and applying pressure at the lip of the bottle 100 at end region 106. The nut 118 includes one or more teeth 126 such that the notch portion 112 of the cap 104 is sized and shaped to matingly engage the one or more teeth 126 for tightening and loosening of the nut 118 to adjust pressure on, and securement with, the bottle 100 lip (FIG. 35). A variety of other configurations, components, structures, and mating interactions can be employed with the bottle 100, end assembly 114, and cap 104 of the embodiments without deviating from the spirit and scope of the present invention.

The mouthpiece 122 includes a base portion 124 and a threaded portion 128. The nut 118 is threadable along the threaded portion 128, with the cap 104 adapted to threadably engage an end portion of the mouthpiece 122. The base portion 124 of the mouthpiece 122 includes an end tab or lip region 124*a* configured for insertion into the mouth opening end 106 to secure the assembly 114 to the bottle 100, with the threaded portion 128 extending out from the opening end 106, as depicted in FIG. 34. The assembly 114 and cap 104 can be provided at either or both ends of the bottle 100. To prevent the mouthpiece 122 from spinning around inside the bottle 100 when the user attempts to screw on and tighten a cap, the lip region 124*a* includes one or more notches that engage with structures 130 inside the bottle 100 at the opening end 106. This provides the user with leverage while screwing on and tightening (or loosening) a cap and prevents the mouthpiece 122 from undesirably moving around while in use. Other structures, components, and techniques can be employed to prevent the mouthpiece 122 from spinning inside of the bottle 100 during tightening of the cap.

Figure 36:
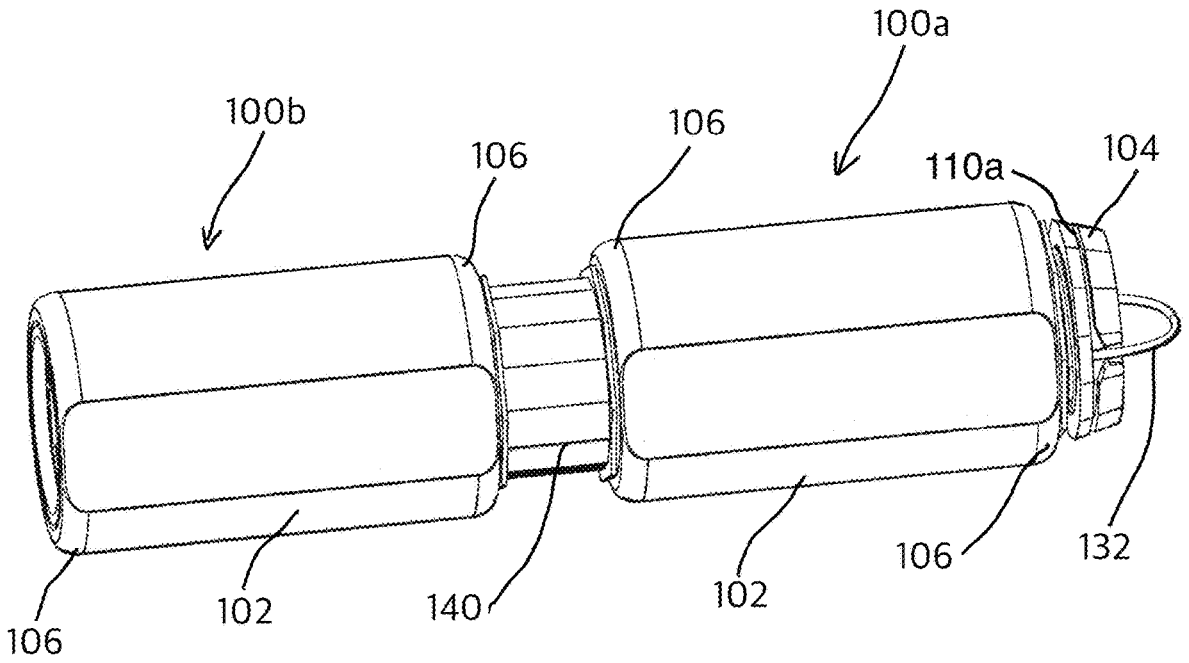
FIG. 36 shows two modular utility bottles interconnected, in accordance with embodiments of the present invention.
Figure 37:
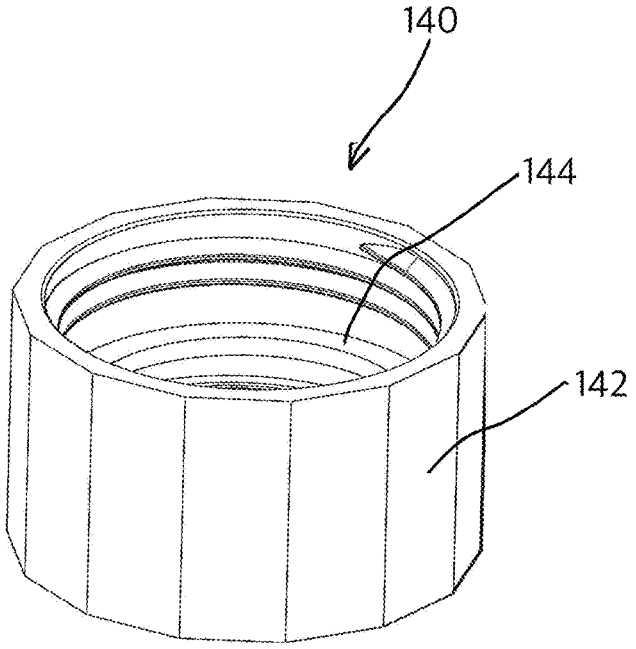
FIG. 37 shows a connector or coupling element to join two modular utility bottles, in accordance with embodiments of the present invention.

As shown in FIGS. 36-37, the present invention can include two distinct bottles 100*a* and 100*b*, attached end-to-end via a connector or coupling element 140 to provide an extended bottle capable of holding additional material or contents. The coupling element 140 can include an outer wall 142 (e.g., with flats) and internal threading 144. The internal threading 144 is configured to conjoin the two bottles 100*a*, 100*b*, opening-to-opening. It is noted that more than two bottles can be easily joined end-to-end via the disclosed connectors and techniques. In addition, any of the caps disclosed herein can be provided on the ends of the bottles 100*a*, 100*b* opposite the coupling element 140.

FIG. 36 also depicts an alternate loop element 132 that can be included with any of the embodiments of the present invention. The loop 132 is adapted to hang the bottle 100 vertically when in use as a shower, a lantern, for attachment to a backpack or other structure, etc. Further, the loop 132 can be tucked away when not in use, using an indented ring shape channel or groove 110*a* defined in the side wall of the cap including this loop 132. In addition, the loop 132 (e.g., silicon, paracord, etc.) can be run through the inside of the cap 104 using apertures on either side of the cap 104. Other designs, structures, elements, and techniques can be utilized to attach, fold, or otherwise provide the loop to the cap or bottle.

Figure 38:
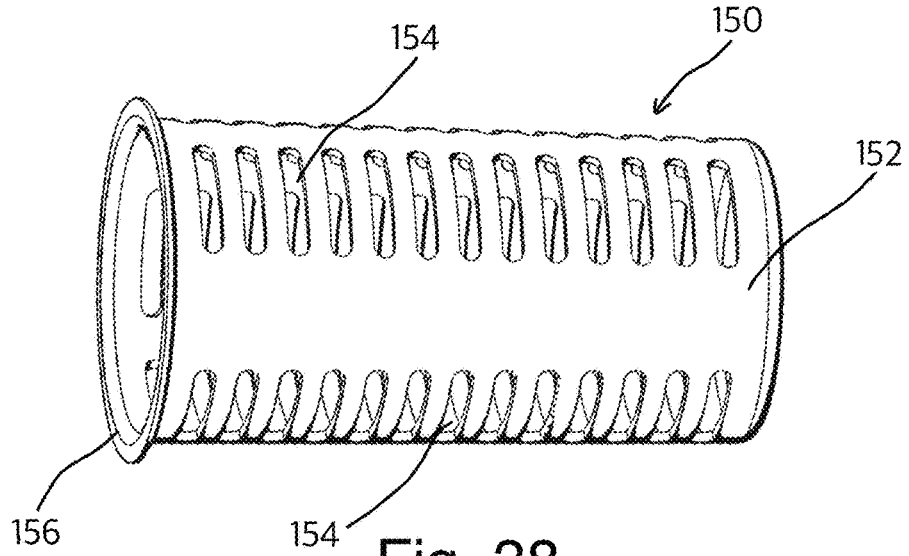
FIG. 38 shows an infuser accessory for use with a modular utility bottle, in accordance with embodiments of the present invention.
Figure 39:
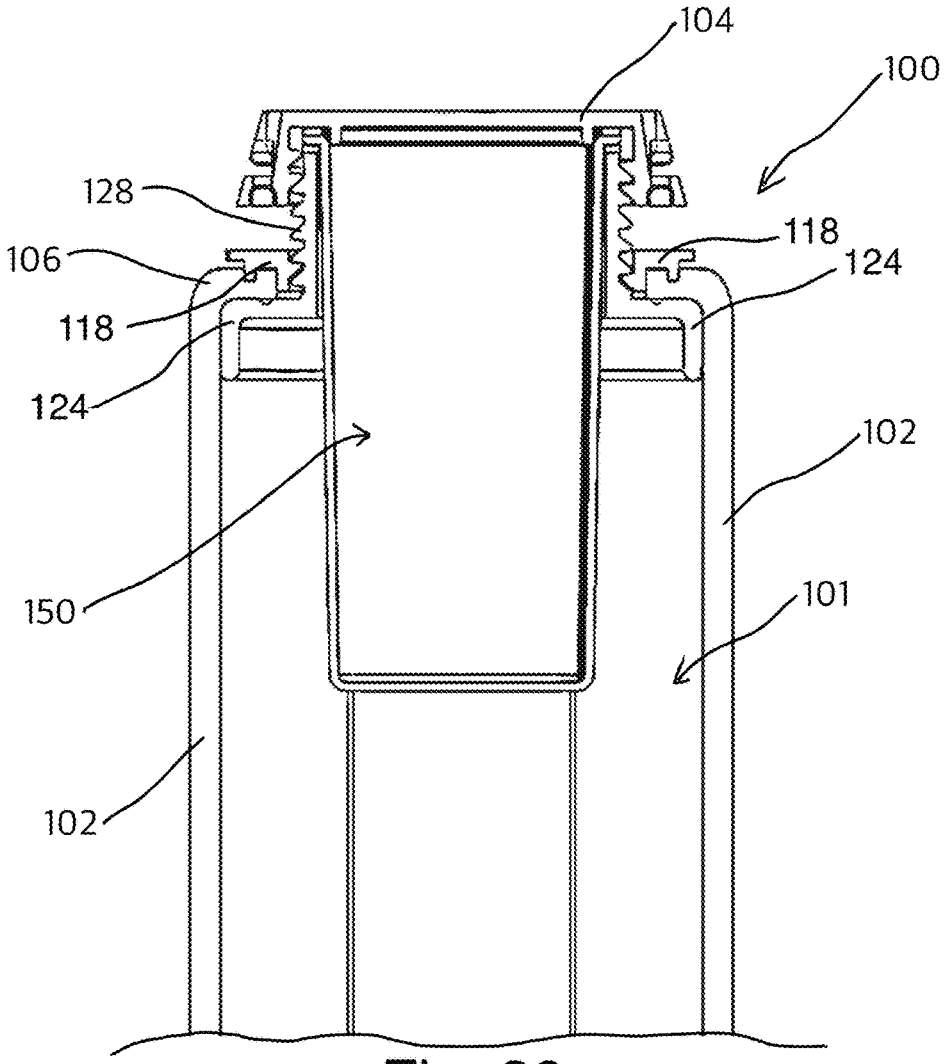
FIG. 39 is a cross-sectional view of an infuser accessory included with a modular utility bottle, in accordance with embodiments of the present invention.

Referring to FIGS. 38-39, a cylindrical infuser accessory 150 is provided for use with the bottle 100 of the present invention. The infuser 150 can include a body portion 152 having a plurality of infusion slits or cuts 154, and an opening end 156 that faces or is aligned with the mouth of the bottle 100. The infuser 150 can be selectively provided with the assembly 114, or other structures and portions of the various cap embodiments disclosed herein, to secure it within the bottle 100. Fruit, tea, coffee, and like content can be placed in the infuser 150, along with liquid (e.g., water) in the bottle, such that the contents of the infuser 150 communicate with the water to enhance or alter the flavor of the liquid.

Figure 40:
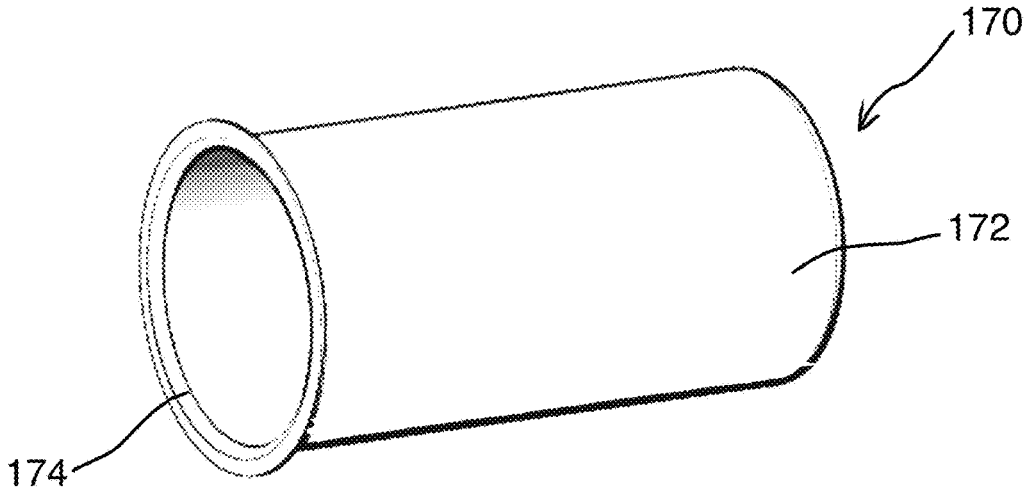
FIG. 40 shows a content container accessory for dry storage and use with a modular utility bottle, in accordance with embodiments of the present invention.

FIG. 40 shows a container accessory 170 that is generally cylindrical and can include a body portion 172 and an opening 174. Like the infuser 150, the container 170 can be secured with and placed within the bottle via coupling with the assembly 114, or other structures and portions of the various cap embodiments disclosed herein. The container 170 can provide dry storage space (e.g., food, powder, keys, papers, etc.) within the bottle 100, similar to cap 200.

Figure 41:
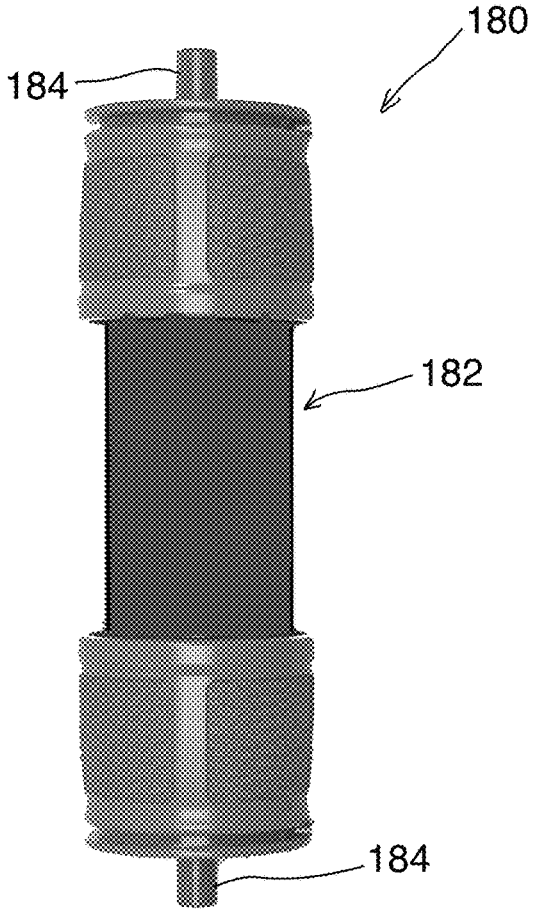
FIG. 41 shows a filter or purifier accessory for use with a modular utility bottle, in accordance with embodiments of the present invention.

FIG. 41 shows a purifier or filter accessory 180 having a filter body 182, and a connector conduit 184. The filter body 182 includes filtering mechanisms or devices. The connector conduit 184 is configured for operative connectivity with the barbed spigot 212 of the cap, including the interior spigot portion 214 or other structures and portions of the various cap embodiments disclosed herein. With certain embodiments, a separate detachable conduit or straw can be included to connect the filter 180 (e.g., at conduit 184) and the barbed spigot 212. As such, a user can fill up the bottle 100, via the barbed spigot 212, with water from any stream, river, or the like, and obtain drinkable water with the purifying filter within the bottle 100. In addition, users can fill up the bottle 100 with water (e.g., from streams, rivers, etc.) and attach the filter 180 to the outer barbed spigot 212 of the cap 210 and hang the bottle 100 upside down, thereby allowing water to flow through the filter 180 continuously to obtained purified or filtered water out of the bottle 100. This technique can be employed to fill up multiple bottles, large containers, and the like with purified water.

As detailed above, the present invention provides a highly modular bottle that can easily be collapsed in certain embodiments when not in use (for storage, transport, and use in other forms), results in a secured bottle when clipped to a backpack or other structure as a result of the two-point loop anchoring, is less likely to become dirty over time, is easily disassembled for cleaning, does not roll when placed on its side, and can include a multitude of caps and accessories providing distinct functionality advantages. A myriad of other caps and accessories disclosed herein can be provided with and used with the bottle 100 to provide a modular kit, thereby expanding the functional options for the bottle 100. The bottle 100 can be employed for many tasks other than as a bottle or container, such as preparing food or drink (ramen, tea, coffee, etc.), as a neck pillow, as an air pump, a rain catcher, an IV drip, and the like.

Various materials have been identified for construction of all or part of the components described herein. However, other acceptable materials are envisioned for use as well. For instance, while polypropylene, silicone, and stainless steel, etc. have been identified, other materials can be employed without deviating from the spirit and scope of the present invention.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

What is claimed is:

1. A bottle system, comprising:

a body portion including an open longitudinal end and an interior region;

an end cap configured to be secured over the open longitudinal end to enclose the interior region, wherein the end cap comprises a pair of knobs disposed on a circumferential side surface of the end cap; and a flexible loop, wherein each end of the flexible loop defines an aperture that is smaller than a largest diameter of each of the pair of knobs such that each end of the flexible loop is selectively couplable with each of the pair of knobs, wherein each of the pair of knobs comprises a head portion and a neck portion, wherein the head portion has a larger diameter dimension than the neck portion wherein the head portion defines an upper edge and a lower edge, and wherein the lower edge is planar and the upper edge is pointed at a midpoint thereof with a downward slope towards lateral sides thereof.

2. The bottle system of claim 1, wherein the end cap includes a barb connector in fluid communication with the interior region, the barb connector immovably extending outwardly away from the body portion from an outer surface of the first end cap.

3. The bottle system of claim 2, wherein the end cap further defines an interior spigot portion in fluid communication with the barb connector, the interior spigot portion extending internally into the interior region of the body portion when the end cap is secured over the open longitudinal end to enclose the interior region.

4. The bottle system of claim 2, further including a nozzle configured to removably connect with the barb connector.

5. The bottle system of claim 4, wherein the nozzle includes a flexible connector arm extending outward from the nozzle.

6. The bottle system of claim 1, wherein the body portion is constructed at least in part of a collapsible material.

7. The bottle system of claim 1, wherein the end cap and body portion are configured to be secured together via threads.

8. The bottle system of claim 1, wherein the end cap includes a one-way valve in fluid communication with the interior region, wherein the one-way valve is provided to a planar portion of the end cap in a position laterally offset from a radial center point thereof.

9. The bottle system of claim 1, wherein the body portion includes a pair of longitudinal flat side portions that lie opposite one another and a pair of curved side portions that are each disposed between adjacent flat side portions, lie opposite one another, and span from an edge of one of the pair of longitudinal flat side portions to the other one of the pair of longitudinal flat side portions.

10. The bottle system of claim 1, wherein each of the pair of knobs lies circumferentially opposite one another in a common plane.

11. The bottle system of claim 1, wherein the upper edge is thinner than the lower edge.

12. The bottle system of claim 1, wherein the flexible loop comprises an elongated strap with opposing rounded ends, wherein each opposing rounded end includes the aperture.

13. A bottle system, comprising:

a body portion including an open longitudinal end and an interior region;

an end cap that can be secured over the open longitudinal end to enclose the interior region, the end cap including a plurality of knobs disposed on a circumferential side surface of the end cap; and a flexible loop member, wherein each end of the flexible loop member includes an aperture that is smaller than a largest diameter of each of the plurality of knobs such that each end of the flexible loop is selectively couplable with each of the plurality of knobs wherein each of the plurality of knobs comprises a head portion and a neck portion, wherein the neck portion lies between the head and the circumferential side surface of the end cap, wherein the head portion has a larger diameter dimension than the neck portion, and wherein the head portion defines an upper edge and a lower edge, wherein the upper edge is thinner than the lower edge.

14. The bottle system of claim 13, wherein the lower edge is planar and the upper edge is pointed at a midpoint thereof with a downward slope towards lateral sides thereof.

15. The bottle system of claim 13, wherein the flexible loop comprises an elongated strap with opposing rounded ends, wherein each opposing rounded end includes the aperture.

16. The bottle system of claim 13, wherein the head portion defines a wedge-shaped upper portion and a planar lower edge opposite the wedge-shaped upper portion.

* * * * *